US009643436B2

(12) United States Patent
Häcker et al.

(10) Patent No.: US 9,643,436 B2
(45) Date of Patent: May 9, 2017

(54) PRINTING PRESS AND A METHOD FOR THREADING A PRINTING MATERIAL WEB INTO A PRINTING UNIT OF A PRINTING PRESS

(71) Applicant: Koenig & Bauer AG, Würzburg (DE)

(72) Inventors: Christoph Häcker, Karlstadt (DE); Mathias Metz, Mainstockheim (DE); Stefan Wander, Helmstadt (DE)

(73) Assignee: Koenig & Bauer, AG, Wurzburg (DE)

( * ) Notice: Subject to any disclaimer, the term of this patent is extended or adjusted under 35 U.S.C. 154(b) by 0 days.

(21) Appl. No.: 14/889,156

(22) PCT Filed: May 12, 2014

(86) PCT No.: PCT/EP2014/059623

§ 371 (c)(1),
(2) Date: Nov. 5, 2015

(87) PCT Pub. No.: WO2014/184130

PCT Pub. Date: Nov. 20, 2014

(65) Prior Publication Data

US 2016/0075154 A1 Mar. 17, 2016

(30) Foreign Application Priority Data

May 13, 2013 (DE) ..... 10 2013 208 754

(51) Int. Cl.
*B41J 15/04* (2006.01)
*B41J 25/304* (2006.01)
*B41J 2/01* (2006.01)

(52) U.S. Cl.
CPC ..... *B41J 15/04* (2013.01); *B41J 2/01* (2013.01); *B41J 15/042* (2013.01); *B41J 25/304* (2013.01)

(58) Field of Classification Search
CPC ... B41J 15/04; B41J 2/01; B41J 15/042; B41J 25/304
See application file for complete search history.

(56) References Cited

U.S. PATENT DOCUMENTS 5,206,666 A 4/1993 Watanabe et al.
5,566,616 A 10/1996 Schleinz et al.
(Continued)

FOREIGN PATENT DOCUMENTS

DE 2349453 A1 4/1975
DE 4318299 A1 12/1994
(Continued)

OTHER PUBLICATIONS

International Search Report of PCT/EP2014/059623.

*Primary Examiner* — Bradley Thies
(74) *Attorney, Agent, or Firm* — Mattingly & Malur, PC

(57) ABSTRACT

A printing press has a printing unit with a print head, which is configured as an ink jet printing head, and a printing material guiding element which can be rotated about a respective rotational axis. The print can be moved along an actuating path in an actuating direction. The actuating direction has a component which is oriented orthogonally to an axial defined by the rotational axis of the printing material guiding element. A threading assembly, for threading in a printing material web along a threading path, is arranged within the printing unit. Parts of the threading path are spaced at least two centimeters from the axial direction in relation to every target region of every nozzle of every printing head of the printing unit. A method for threading a printing material web into the printing unit utilizes the threading assembly.

11 Claims, 15 Drawing Sheets

(56) References Cited

U.S. PATENT DOCUMENTS

| | | | | |
|---|---|---|---|---|
| 5,757,399 | A | 5/1998 | Murayama et al. | |
| 6,053,107 | A | 4/2000 | Hertel et al. | |
| 7,455,401 | B2 | 11/2008 | Koto et al. | |
| 8,262,198 | B2 | 9/2012 | Ishii et al. | |
| 2003/0061953 | A1* | 4/2003 | Bruckl | B41F 13/03 101/228 |
| 2005/0024421 | A1 | 2/2005 | Barinaga et al. | |
| 2006/0119646 | A1 | 6/2006 | Berry et al. | |
| 2008/0273063 | A1 | 11/2008 | Wouters et al. | |
| 2009/0237443 | A1* | 9/2009 | Miramanda | B41J 2/155 347/23 |
| 2009/0284566 | A1 | 11/2009 | Suzuki et al. | |
| 2011/0043554 | A1* | 2/2011 | Silverbrook | B41J 3/60 347/5 |
| 2011/0149003 | A1* | 6/2011 | Kondo | B41J 2/155 347/104 |
| 2011/0149004 | A1* | 6/2011 | Ray | B41J 2/155 347/104 |
| 2011/0150552 | A1 | 6/2011 | McLaughlin et al. | |
| 2012/0288315 | A1 | 11/2012 | Garcia et al. | |

FOREIGN PATENT DOCUMENTS

| | | | |
|---|---|---|---|
| DE | 102004017801 | A1 | 3/2005 |
| DE | 102005060786 | A1 | 6/2007 |
| DE | 102010001146 | A1 | 7/2011 |
| DE | 102010037829 | A1 | 3/2012 |
| DE | 102011076899 | A1 | 12/2012 |
| EP | 1197329 | A1 | 4/2002 |
| EP | 2127885 | A1 | 12/2009 |
| EP | 2202081 | A1 | 6/2010 |
| JP | 2003-063707 | A | 3/2003 |
| JP | 2004-268511 | A1 | 9/2004 |

* cited by examiner

PRINTING PRESS AND A METHOD FOR THREADING A PRINTING MATERIAL WEB INTO A PRINTING UNIT OF A PRINTING PRESS

CROSS-REFERENCE TO RELATED APPLICATIONS

This application is a U.S. national phase, under 35 U.S.C. §371, of PCT/EP2014/059623, filed May 12, 2014; published as WO 2014/184130A1 on Nov. 20, 2014 and claiming priority to DE 10 2013 208 754.3, filed May 13, 2013, the disclosures of which are expressly incorporated herein by reference in their entireties.

FIELD OF THE INVENTION

The present invention is directed to a printing press which has at least one printing unit that has at least one print head which is embodied as an ink jet print head, and further has at least one printing material guiding element that is capable of rotating around a respective rotational axis. The at least one print head is movable along an actuating path in at least one actuating direction. The actuating direction has at least one component which is oriented orthogonally to an axial direction which is defined by the rotational axis of the at least one printing material guiding element. The present invention is also directed to a method for threading a printing material web into a printing unit of a printing press.

BACKGROUND OF THE INVENTION

A variety of different printing processes for use in printing presses are known. One such printing process is inkjet printing or ink-jet printing. In this process, individual droplets of printing ink are ejected through nozzles of print heads and are transferred to a printing material so as to produce a printed image on the printing material. By actuating a plurality of nozzles individually, different printed images can be produced. Since no fixed printing forme is involved, each printed product can be produced individually. This allows personalized printed products to be produced, and/or, since printing forms are dispensed with, allows small print runs of printed products to be produced at low cost.

The precise alignment of printed images on the front and back sides of a printing material that is imprinted on both sides is referred to as register (DIN 16500-2). In multicolor printing, the merging and precise correlation of individual printed images of different colors to form a single image is referred to as color-to-color registration (DIN 16500-2). Suitable measures are necessary in inkjet printing in order to maintain color-to-color registration and/or register.

EP 2 202 081 A1 and JP 2003-063707 A each disclose a printing press which has a first printing unit and a dryer, the first printing unit comprising a central cylinder with a separate drive motor assigned to the first central cylinder and at least one inkjet print head.

U.S. Pat. No. 5,566,616 A discloses a printing press comprising a rotatable central cylinder, inkjet print heads, a cooling unit and a dryer, which operates using either temperature and air flow or radiation-induced curing.

U.S. Pat. No. 6,053,107 A discloses a printing press which has a driven central cylinder and a dryer with a cooling unit.

DE 10 2011 076 899 A1 discloses a printing press which has at least one printing unit and at least one print head embodied as an inkjet print head.

DE 10 2010 001 146 A1 and DE 43 18 299 A1 each disclose a threading means for threading web-type printing material into a printing press. EP 1 197 329 A1 discloses a threading tip that can interact with a threading belt or a threading chain. US 2011/0043554 A1 discloses a printing press in which at least one printing material guiding element is moved away from at least one print head in order to thread in a material web.

DE 10 2004 017 801 A1, US 2005/0024421 A1, DE 10 201 0 037 829 A1, JP 2004 268 511 A, US 2006/0119646 A1, U.S. Pat. No. 5,206,666 A, U.S. Pat. No. 5,757,399 A and U.S. Pat. No. 7,455,401 B2 each disclose a printing press comprising print heads and a maintenance device that can be moved along an actuating path. US 2011/0149004 A1 discloses a printing press having print heads that can be moved along an actuating path. U.S. Pat. No. 8,262,198 B2 discloses a printing press with adjustable print heads. DE 23 49 453 A1 discloses movable nozzles of a liquid jet recorder.

US 2009/0284566 A1 discloses a printing press in which four positioning devices can be used to move print heads in different linear directions to ensure positioning accuracy, and said print heads can be transported to a stationary maintenance device by moving parallel to a rotational axis of a printing material guiding element.

DE 10 2005 060 786 A1, EP 2 127 885 A1 and US 2008/0273063 A1 each disclose a printing press which has at least one system for supplying coating medium and at least two inkjet print heads, each of which is connected via a fluid line to a main reservoir, the main reservoir being connected via a supply line and a drain line to an intermediate reservoir.

SUMMARY OF THE INVENTION

The object of the present invention is to provide a printing press and a method for threading a printing material web into a printing unit of a printing press.

This object is attained according to the invention by the provision of at least one threading device that can be moved along at least one threading path for threading in a printing material web. The at least one threading device is or can be arranged at least intermittently at least within one printing unit. At least portions of the at least one threading path are spaced at a distance of at least two centimeters with respect to the axial direction from every target region of every nozzle of every print head of the printing unit. In a throw-off process, at least one of the print heads of at least one printing unit, which is embodied as an ink jet printing head, can be moved in at least one actuating direction which is away from a provided transport path of the at least one printing material web. In a subsequent threading in process, at least one threading device is moved along a threading path through the at least one printing unit, thereby drawing the at least one printing material web along a transport path which is provided for the at least one printing material web. The threading path and the transport path are spaced from one another, as viewed in the axial direction.

A printing press preferably has at least one printing unit, wherein the at least one printing unit preferably has at least one print head, particularly embodied as an inkjet print head, and preferably has at least one printing material guiding element that is rotatable around a rotational axis, and wherein the at least one print head can preferably be positioned in at least one idle position, preferably embodied as a maintenance position, in which preferably at least one maintenance device is and/or can be assigned to at least one nozzle of the at least one print head. The at least one print head can preferably be placed in at least one printing position. The ejecting direction of at least one nozzle of the at least one print head, at least in a printing position, is preferably aligned toward a circumferential surface of the at least one printing material guiding element. The at least one maintenance device is preferably embodied as at least one protective cover and/or as at least one cleaning device.

The at least one printing unit preferably has the at least one printing material guiding element, which is capable of rotating around a rotational axis that defines an axial direction. The at least one printing unit preferably has at least four print heads, particularly embodied as inkjet print heads. In the at least one printing unit, at least four positioning devices are preferably provided, by means of each of which at least one print head can selectively be placed at least either in a respective printing position assigned to said print head or in a respective idle position, in particular a maintenance position and/or assembly position, assigned to said print head. In particular, at least a first print head of the at least four print heads can selectively be placed, in particular by means of at least one first positioning device, at least either in a first printing position assigned to said first print head or in a first idle position, in particular a first maintenance position and/or a first assembly position, assigned to said first print head. In particular, at least one second print head of the at least four print heads can selectively be placed, in particular by means of at least one second positioning device, at least either in a second printing position assigned to said second print head or in a second idle position, in particular a second maintenance position and/or a second assembly position, assigned to said second print head. The respective idle position is preferably embodied as a respective maintenance position, in which at least one maintenance device, embodied as a cleaning device, preferably is and/or can be assigned to at least one nozzle of the respective print head. One advantage is that, since the maintenance device and the print heads must be moved only short distances relative to one another, a particularly compact printing unit is possible.

In particular, the first idle position is preferably embodied as a first maintenance position, in which at least one first maintenance device, embodied as a first cleaning device, is and/or can be assigned to at least one nozzle of the first print head. In particular, the second idle position is preferably embodied as a second maintenance position, in which at least one second maintenance device, embodied as a second cleaning device, is and/or can be assigned to at least one nozzle of the second print head. In particular, at least one third idle position of a third print head is preferably embodied as a third maintenance position, in which at least one third maintenance device embodied as a third cleaning device is and/or can be assigned to at least one nozzle of the third print head. In particular, at least one fourth idle position of a fourth print head is preferably embodied as a fourth maintenance position, in which at least one fourth maintenance device embodied as a fourth cleaning device is and/or can be assigned to at least one nozzle of the fourth print head.

The at least one maintenance device is preferably arranged as movable along a staging path, at least partially orthogonally to the axial direction. In particular, the at least one first maintenance device is preferably arranged as movable along a first staging path, at least orthogonally to the axial direction. In particular, the at least one second maintenance device is preferably arranged as movable along a second staging path, at least orthogonally to the axial direction.

A minimum distance, preferably referred to as the idle distance, in particular the maintenance distance and/or assembly distance, between at least one first nozzle of the at least one first print head in its first idle position and at least one second nozzle of the at least one second print head in its second idle position is preferably at least 2 cm, more preferably at least 5 cm, even more preferably at least 10 cm and more preferably still at least 20 cm greater than a minimum distance, preferably referred to as the operating distance, between at least the at least one first nozzle of the at least one first print head in its first printing position and the at least one second nozzle of the at least one second printing head in its second printing position. This results particularly in the advantage that the at least four print heads are more accessible for maintenance and/or assembly purposes, but are nevertheless situated close to one another during printing operation, allowing high print quality to be achieved due to fewer negative influences between applications of printing ink of different colors.

Printing ink in the above and in the following is understood generally as a coating medium, particularly also a varnish. In particular, no differentiation is made between printing ink and ink; printing ink and coating medium are also understood to include particularly inks.

Print heads are embodied, for example, such that each individual print head does not extend across an entire working width of the printing press, defined by a maximum printing material width that can be processed in the printing press. A plurality of print heads are thus preferably assigned to the same printing ink, and/or at least one nozzle bar is preferably provided, which further preferably contains a plurality of print heads that can be moved together by means of the same positioning device. At least four positioning devices are particularly preferably provided in the printing unit, by means of each of which at least one nozzle bar and/or respectively a plurality of print heads assigned to the same printing ink are embodied as movable together, and in particular are and/or can be selectively placed at least either in a respective printing position assigned to said nozzle bar and/or said print heads or in a respective idle position assigned to said nozzle bar and/or said print heads. The positioning devices are preferably positioning devices of the printing unit and are particularly components of the printing unit. In particular, the at least one print head is preferably arranged such that it can be moved away from a transport path provided for at least one printing material web, by means of at least one positioning device. The at least one printing unit preferably has at least two, particularly at least four nozzle bars, each of which has at least two, particularly at least four print heads, and the at least two, in particular at least four nozzle bars are arranged so as to be movable along a respective linear actuating path by means of a respective positioning device. The printing press is preferably characterized in that each nozzle bar, individually and independently of other nozzle bars, can be moved along its actuating path and/or can be placed in its printing position and/or its idle position by means of the positioning device assigned to said nozzle bar.

The at least one printing unit preferably has at least one positioning device per double row of print heads arranged in the printing unit, and/or at least one positioning device per nozzle bar arranged in the printing unit and/or at least one positioning device per coating medium arranged in the printing unit.

The printing press is preferably characterized in that the at least one maintenance device is arranged such that it can be moved by means of at least one transport device along at least one staging path between at least one parked position and at least one operating position. The at least one maintenance device is preferably arranged such that it can be moved at least orthogonally to the axial direction A. The printing press is preferably characterized in that the respective maintenance device in its respective operating position is assigned to the respective at least one nozzle of the respective print head in its maintenance position. When any print head is arranged in its printing position, at least one nozzle of said respective print head is preferably situated below the staging path of the respective at least one maintenance device, and when any print head is arranged in its idle position, said respective at least one nozzle is preferably situated above said respective staging path.

The respective staging path of the particularly four maintenance devices preferably extends linearly and in a respective or common direction that deviates a maximum of 45°, preferably a maximum of 30°, more preferably a maximum of 20° and even more preferably a maximum of 10° from a horizontal direction. The respective or common staging direction is preferably horizontal.

The printing press is preferably characterized in that a location of at least one reference nozzle of a respective print head in its printing position differs from a location of said at least one reference nozzle of said respective print head in its maintenance position, with respect to an axial direction defined by the rotational axis of the at least one printing material guiding element, by a maximum of 50% of the width, measured in the axial direction, of an operating region of a nozzle bar that contains the respective print head, and/or by a maximum of 50% of a working width of the printing press, defined by a maximum printing material width that can be processed in the printing press. This allows a particularly space-saving printing press to be realized, which is nevertheless easy to maintain and the print heads of which are preferably easy to install and remove. In particular, the printing press is preferably characterized in that a location of the at least one first nozzle in the at least one printing position differs from a location of said at least one first nozzle in the at least one maintenance position, with respect to an axial direction defined by the rotational axis of the at least one printing material guiding element, by a maximum of 50% of the width, measured in the axial direction, of the operating region of the nozzle bar that contains the at least one print head, and/or by a maximum of 50% of the working width of the printing press, defined by the maximum printing material width that can be processed in the printing press.

In the at least one maintenance position of the respective print head, at least one maintenance device preferably is and/or can be assigned to at least one nozzle of the at least one print head, and more preferably, the at least one maintenance device is and/or can be arranged at least partially opposite at least one nozzle of the at least one print head with respect to a respective ejecting direction of the at least one nozzle.

The printing press is preferably characterized in that at least a first of at least two print heads, particularly of a first printing unit, can selectively be placed, preferably by means of a respective first positioning device assigned to said print head, at least either in the first printing position assigned to said print head or in a first idle position, particularly a maintenance position and/or an assembly position, assigned to said print head, wherein in the at least one first idle position, an idle location of at least one first nozzle of the at least one first of the at least two print heads is spaced by a first idle distance, in particular a maintenance distance and/or an assembly distance, from a first operating location of the same at least one first nozzle of the same at least one first of the at least two print heads in its first printing position. Preferably, at least a second of the at least two print heads, particularly of said first printing unit, can selectively be placed, preferably by means of a respective second positioning device assigned to said print head, at least either in a second printing position assigned to said print head or in a second idle position, in particular a maintenance position and/or assembly position, assigned to said print head, wherein in the at least one second idle position, an idle location of at least one second nozzle of the at least one second of the at least two print heads is spaced by a second idle distance, in particular a maintenance distance and/or an assembly distance, from a second operating location of the same at least one second nozzle of the same at least one second of the at least two print heads in its second printing position.

The first idle distance, in particular maintenance distance and/or assembly distance, preferably differs from the second idle distance, in particular maintenance distance and/or assembly distance, by at least 2 cm, more preferably at least 5 cm, even more preferably at least 10 cm and more preferably still at least 20 cm. An idle distance is particularly a distance between a location of a nozzle when the print head containing said nozzle is arranged in its idle position and a location of the same nozzle when the same print head is arranged in its printing position. This results particularly in the advantage, for example, of allowing a rectilinear and therefore simple and cost-effective transport device to be provided, by means of which one maintenance device can be used for different print heads. As a further advantage, sufficient space is then available for all maintenance devices in their respective operating positions. At least two print heads, arranged on different positioning devices, of the total of at least four print heads preferably arranged on different positioning devices preferably have the same idle distances in pairs. This is achieved, for example, by a symmetrical arrangement of the positioning devices, in which, for example, one plane of symmetry contains the entire rotational axis of the at least one printing material guiding element.

The printing press is preferably characterized in that, when a third print head is arranged in its idle position, an idle location of at least a third nozzle of the at least one third print head is spaced by a third idle distance from an operating location of the same at least one third nozzle of the same at least one third print head in its third printing position, and in that, when the fourth print head is arranged in its idle position, an idle location of the at least one fourth nozzle of the at least one fourth print head is spaced by a fourth idle distance from an operating location of the same at least one fourth nozzle of the same at least one fourth print head in its fourth printing position, and in that the third idle distance is equal to the second idle distance and/or in that the fourth idle distance is equal to the first idle distance.

The printing press is preferably characterized in that, when particularly the first print head is arranged in the particularly first maintenance position, at least one particularly first maintenance device can be and/or is arranged between the at least one particularly first nozzle of the at least one particularly first print head and a region of the transport path provided for the printing material, which region is closest to said at least one particularly first nozzle, and/or in that when particularly the first print head is arranged in the at least one particularly first maintenance position, at least one particularly first maintenance device can be and/or is arranged between the at least one particularly first nozzle of the at least one particularly first print head and a region of a transfer element, which region is closest to said at least one particularly first nozzle.

The printing press, which preferably has at least one printing unit, preferably having at least two and more preferably at least four print heads and at least one printing material guiding element that is rotatable around a rotational axis that defines an axial direction, is preferably characterized in that each of the at least two print heads is arranged so as to be movable along a respective linear actuating path by means of a respective positioning device, assigned at least to said print head, wherein the linear actuating paths point in respective actuating directions that differ in pairs by at least 10° and by at most 150°. Further preferably, each of the at least two print heads can selectively be placed, by means of the respective positioning device, at least either in a printing position assigned to said print head or in at least one maintenance position assigned to said print head. Further preferably, when a first print head of the at least two print heads is in the at least one maintenance position, at least one maintenance device is and/or can be assigned to at least one first nozzle of said at least one first print head. Further preferably, the at least one maintenance device is arranged so as to be movable along at least one staging path between at least one parked position and at least one operating position, at least partially orthogonally to the axial direction, by means of at least one transport device. This results particularly in the advantage that the printing unit can be highly compact in configuration. Arranging the linear actuating paths at corresponding angles, for example around a central cylinder, requires less installation space than if all the print heads were to be arranged so as to be movable in the axial direction or in opposite directions. The at least partially orthogonal mobility of the maintenance device likewise favors a compact configuration of the printing unit, especially since the maintenance device can be the same width as the operating region of the nozzle bars and the printing unit, but need not be twice as wide. As compared with print heads that are movable parallel to one another, an enlarged space for maintenance devices in their operating positions is produced, while the printing positions of the print heads are arranged very close to one another.

The printing press preferably has at least one printing unit, which preferably has at least one print head embodied as an inkjet print head. The at least one printing unit preferably has at least one printing material guiding element, which is rotatable around a respective rotational axis. The at least one print head is preferably embodied as movable along an actuating path in at least one actuating direction, the actuating direction preferably having at least one component oriented orthogonally to the axial direction which is defined by the rotational axis of the at least one printing material guiding element. The printing press is preferably characterized in that at least one and preferably precisely one threading means for threading in a web of printing material, which threading means can be moved along at least one threading path and is preferably continuous, is and/or can be arranged, at least intermittently, at least within a printing unit, and in that at least parts of the at least one threading path are spaced a distance of at least 2 cm with respect to the axial direction from every target region of every nozzle of every print head of said printing unit. At least parts of the at least one threading path and preferably the entire threading path are/is preferably spaced a distance of at least 2 cm, more preferably at least 4 cm, even more preferably at least 6 cm and more preferably still at least 8 cm, with respect to the axial direction, from every target region of every nozzle of every print head of said printing unit. Preferably at least parts of the threading means and more preferably the entire threading means are/is spaced a distance of at least 2 cm, more preferably at least 4 cm, even more preferably at least 6 cm and more preferably still at least 8 cm, with respect to the axial direction, from every target region of every nozzle of every print head of said printing unit. This results particularly in the advantage that a printing material web can be threaded particularly easily and quickly and precisely into the printing press, with no risk of damage to and/or soiling of the nozzles of print heads occurring during the process.

The printing press is preferably characterized in that at least one printing material web is and/or can be connected via at least one connecting element to the at least one threading means, wherein the at least one connecting element is more preferably embodied as at least one threading tip. The printing press is preferably characterized in that the at least one threading means is embodied as at least one continuous threading belt and/or in that at least one threading guide element is provided, by means of which the at least one threading path of the at least one threading means can be and/or is defined, wherein the at least one threading guide element is more preferably embodied as at least one turning roller or as at least one chain guide, and/or the at least one threading guide element is embodied as at least one rotatable threading guide element.

The at least one threading means for threading in a printing material web along the provided transport path of the printing material web is preferably arranged, particularly permanently, along its at least one threading path within the printing press. The at least one threading means preferably has at least two and more preferably at least five designated connecting points at which at least one printing material web can be connected, directly and/or via at least one connecting element, to the at least one threading means. The printing press is preferably characterized in that the at least two connecting points are spaced in the axial direction by a maximum of 10 cm, more preferably a maximum of 5 cm, even more preferably a maximum of 2 cm and more preferably still by no distance at all, and/or the at least two connecting points are spaced from one another along the at least one threading path. A threading path of the at least one threading means preferably wraps around the at least one rotatable printing material guiding element over an angular range of at least 180°, as viewed from the rotational axis of the at least one printing material guiding element, and at least one rotatable threading guide element is preferably provided, by which at least one threading path of the at least one threading means can be and/or is defined, and which is arranged so as to rotate around the same rotational axis as at least one printing material guiding element of a printing unit of the printing press. More preferably, the threading path of the at least one threading means, at least along said angular range, has a radius of curvature that differs a maximum of 5 cm from a radius of curvature of said at least one printing material guiding element.

The printing press is preferably characterized in that an axial projection plane is defined by a surface normal that lies parallel to the axial direction or deviates from said axial direction by a maximum of 2°, and in that a projection, in the axial projection plane, of the transport path provided for printing material in the axial direction and a projection, in the axial projection plane, of the threading path provided for the at least one threading means in the axial direction overlap at least over more than 25% of the length of the projection of the threading path provided for the threading means, and/or in that only at least one threading means is provided, which is arranged on only one side of the provided transport path for printing material, with respect to the axial direction, and/or the threading path of said threading means extends on only one side of the provided transport path for printing material. In particular, a method for threading at least one printing material web into at least one printing unit of a printing press can preferably be carried out using the printing press, wherein the axial direction extends parallel to the rotational axis of the at least one printing material guiding element of the at least one printing unit, and wherein in a throw-off process, at least one print head, embodied as an inkjet print head, of the at least one printing unit, is moved in at least one actuating direction away from a provided transport path of the at least one printing material web, and wherein in a subsequent threading process, at least one threading means is moved along a threading path through the at least one printing unit, and thereby draws the at least one printing material web along the transport path provided for the at least one printing material web, and wherein the threading path and the transport path are spaced from one another, as viewed in the axial direction. This at least one actuating direction is preferably oriented at least partially orthogonally to the axial direction.

The method is preferably characterized in that the at least one threading means is connected to the at least one printing material web in a connecting process by means of at least one connecting element. The at least one connecting element preferably passes a printing position of the at least one print head while said head is moved away from the provided transport path and/or is arranged in at least one idle position, and/or the at least one connecting element passes through at least one target region of at least one nozzle of the at least one print head during the threading process, and/or no component of the at least one threading means passes through a target region of a nozzle of the at least one print head during the threading process. The method is preferably characterized in that in a subsequent throw-on process, the at least one print head is moved opposite the at least one actuating direction and/or along an actuating path toward the provided transport path of the at least one printing material web, and/or said print head is placed in its printing position.

The method is preferably characterized in that, during the throw-off process, at least two print heads of the at least one printing unit are moved in a respective actuating direction away from a provided transport path of the at least one printing material web, the respective actuating directions differing in pairs by at least 10° and by at most 150°.

The method is preferably characterized in that, in at least one operating mode, the at least one threading means is connected by means of the at least one connecting element to the printing material, and the at least one print head is moved away from the provided transport path and/or is placed in at least one idle position, and at least one nozzle is aligned with its ejecting direction facing toward the at least one connecting element and/or in that in said at least one operating mode, the at least one connecting element is in contact with the at least one printing material guiding element or with at least one transfer element, and/or in that in said operating mode, the at least one threading means is spaced a distance of at least 2 cm in the axial direction from every target region of every nozzle of every print head of said printing unit.

Preferably, only at least one threading means is used, said threading means being arranged on only one side of the provided transport path for printing material, with respect to the axial direction, and/or the threading path of said threading means extending on only one side of the provided transport path for printing material.

The at least one first printing unit preferably comprises the at least two print heads, particularly embodied as inkjet print heads and preferably arranged on at least one first movable nozzle bar. The printing press is preferably characterized in that the printing press has at least one system for supplying coating medium and in that the at least one supply system has at least one main reservoir and in that each of the at least two print heads is arranged such that it is and/or can be connected via at least one first fluid line to the at least one main reservoir. For example, each of the at least two print heads is arranged such that it is and/or can be connected via at least one first fluid line to the at least one main reservoir. The at least one supply system preferably has at least one return flow reservoir and at least one intermediate reservoir. The at least one main reservoir preferably has at least one overflow drain, which more preferably is and/or can be connected via the at least one return flow reservoir and at least one drain line to the at least one intermediate reservoir, and/or which is preferably embodied as at least one passive overflow drain. The at least one main reservoir and the at least one return flow reservoir are preferably arranged so as to be movable together with the at least one nozzle bar. Preferably, the at least one nozzle bar can selectively be placed by means of at least one of the positioning devices, particularly by means of at least one of the positioning devices of the at least one printing unit, at least either in a printing position assigned to said nozzle bar or in at least one maintenance position assigned to said nozzle bar.

A section of the at least one drain line, within which at least one valve, in particular at least one second valve, is arranged, is preferably located between the at least one overflow drain and the at least one return flow reservoir. At least a first valve is preferably arranged within at least one supply line, and the at least one intermediate reservoir is preferably arranged such that it is and/or can be connected via at least one supply line to the at least one main reservoir. At least one first liquid pump is preferably arranged in the at least one supply line.

It is a particular advantage that the at least one main reservoir can be separated from the at least one return flow reservoir by means of the at least one valve arranged in the drain line between the at least one overflow drain and the at least one return flow reservoir. This allows a pressure within the main reservoir to be increased, for example, so that a nozzle cleaning of the print heads can be performed, and at the same time and independently thereof, coating medium can be removed from the at least one return flow reservoir. In particular, the ability to move the at least one return flow reservoir together with the at least two print heads ensures that coating medium can always drain from the overflow drain under constant conditions and therefore in an optimized manner, for example solely by virtue of gravitational force, even when the positioning device is in the maintenance position. This advantage results particularly when the at least one return flow reservoir is located along the at least one drain line, downstream of the at least one overflow drain and upstream of any pump. At least one return flow pump is preferably arranged along the at least one drain line, downstream of the at least one return flow reservoir. This allows coating medium to be pumped out of the at least one return flow reservoir regardless of the location of the positioning device and regardless of any other adjusted pressure within the at least one main reservoir.

The stated advantages result particularly when, as is preferred, an actuating direction of an actuating path of the at least one nozzle bar, which path can be implemented particularly by means of the at least one positioning device, has at least one component in the vertical direction that preferably measures at least 10 cm, more preferably at least 20 cm and even more preferably at least 30 cm, because without the appropriate measures, hydrostatic pressure changes resulting from the differences in height could result in different conditions. The at least one nozzle bar is further preferably arranged so as to be movable relative to a frame of the printing unit by means of the at least one positioning device, while the at least one intermediate reservoir is arranged stationary relative to the frame of the printing unit. This allows a relatively large intermediate reservoir to be provided, since it does not need to be moved by means of the positioning device.

In addition, the at least one main reservoir is preferably at least indirectly connected to at least one intermediate reservoir via at least one supply line and at least one drain line, and the at least one main reservoir and/or the at least one drain line preferably has at least one overflow drain, the drain side of which is arranged such that it is and/or can be connected at least indirectly to the at least one intermediate reservoir. At least one volume provided as a first gas-filled space is preferably arranged in the at least one main reservoir, and is and/or can be connected via at least a first gas line to at least a first gas pump. This results particularly in the advantage that constant pressure conditions prevail particularly at the print heads, thereby improving printing quality and facilitating handling, for example by decreasing the number of manual adjustments and/or cleaning measures that must be carried out. At least one volume, provided as particularly a third gas-filled space, is preferably arranged in the at least one return flow reservoir, and is and/or can be connected via at least a first equalizing line to at least a first gas pump. For example, a gas volume is provided in the at least one main reservoir, which volume is at a normal pressure which is lower than the ambient pressure present at an ejection side of at least one nozzle of the at least one print head. Further preferably, the at least one first gas line and the at least one equalizing line are and/or can be separably connected to one another via at least one pressure regulator. Thus either the same pressure can be ensured in all relevant gas-filled spaces, or alternatively, for example when the first and second valves are closed, a pressure and the at least one main reservoir supply can be increased, while in the third gas-filled space pressure equalization is enabled, for example during a pumping process. At least two main reservoirs are preferably arranged so as to be movable together with the same at least one nozzle bar, and each of these at least two main reservoirs is preferably arranged such that it is and/or can be connected via at least one first fluid line to at least one of the at least two print heads. This allows uniform hydrostatic pressure to be achieved in all print heads, even if said heads are arranged at different heights. More preferably, the at least two print heads are arranged at different heights relative to one another on the at least one nozzle bar, and the vertical distances of each of the at least two print heads from the respective main reservoir connected to each via a first fluid line are equal, up to a maximum tolerance limit of 1 cm, more preferably 0.5 cm.

The printing press is preferably characterized in that the printing press has at least one first printing unit and at least one system for supplying coating medium, and in that the at least one supply system has at least one main reservoir, and in that each of the at least two print heads is arranged such that it is and/or can be connected via at least a first fluid line to the at least one main reservoir, and in that the at least one main reservoir is connected via at least one supply line and at least one drain line to at least one intermediate reservoir, and in that the at least one main reservoir and/or the at least one drain line has at least one overflow drain, the drain side of which is arranged such that it is and/or can be connected to the at least one intermediate reservoir. This results particularly in the advantage that constant operating conditions for the print heads can be ensured, more particularly that a constant pressure is maintained within the coating medium at nozzle openings of the print heads.

The printing press is characterized, for example, in that an ejecting direction of at least one first nozzle of the at least one first print head in the first printing position differs from the ejecting direction of said at least one first nozzle of the at least one print head in the first idle position, in particular the maintenance position and/or the assembly position, by an angle of at least 5°, more preferably at least 10°, even more preferably at least 15° and more preferably still at least 20°. This applies similarly to at least every four print heads, for example. Preferably, however, the ejecting direction of each nozzle of the at least two, particularly at least four print heads, is the same in the respective printing position and in the respective idle position, in particular maintenance position, assembly position.

Preferably, a location of the at least one nozzle when the print head is arranged in the at least one printing position and a location of the at least one nozzle when the print head is arranged in the at least one idle position, in particular the maintenance position and/or assembly position, with respect to the axial direction defined by the rotational axis of the at least one printing material guiding element, differ by a maximum of 50%, more preferably a maximum of 20%, even more preferably a maximum of 10% and more preferably still a maximum of 2% of the width, measured in the axial direction, of the operating region of the nozzle bar that contains the at least one print head, and/or by a maximum of 50%, more preferably a maximum of 20%, even more preferably a maximum of 10% and more preferably still a maximum of 2% of the working width of the printing press, defined by the maximum printing material width that can be processed in the printing press. This results particularly in the advantage that constant conditions are enabled for all print heads during maintenance processes and/or particularly with a similar or the same maintenance device, while at the same time allowing the geometry during printing operation to be optimized to a specific print operation. A plane in which this angle is measured is preferably defined by a surface normal which extends parallel to the axial direction A or deviates from said axial direction A by a maximum of 2°; more preferably, said plane is the axial projection plane.

BRIEF DESCRIPTION OF THE DRAWINGS

Embodiment examples of the invention are depicted in the set of drawings, and will be described in greater detail in the following.

The drawings show.

DESCRIPTION OF PREFERRED EMBODIMENTS

Figure 1A:
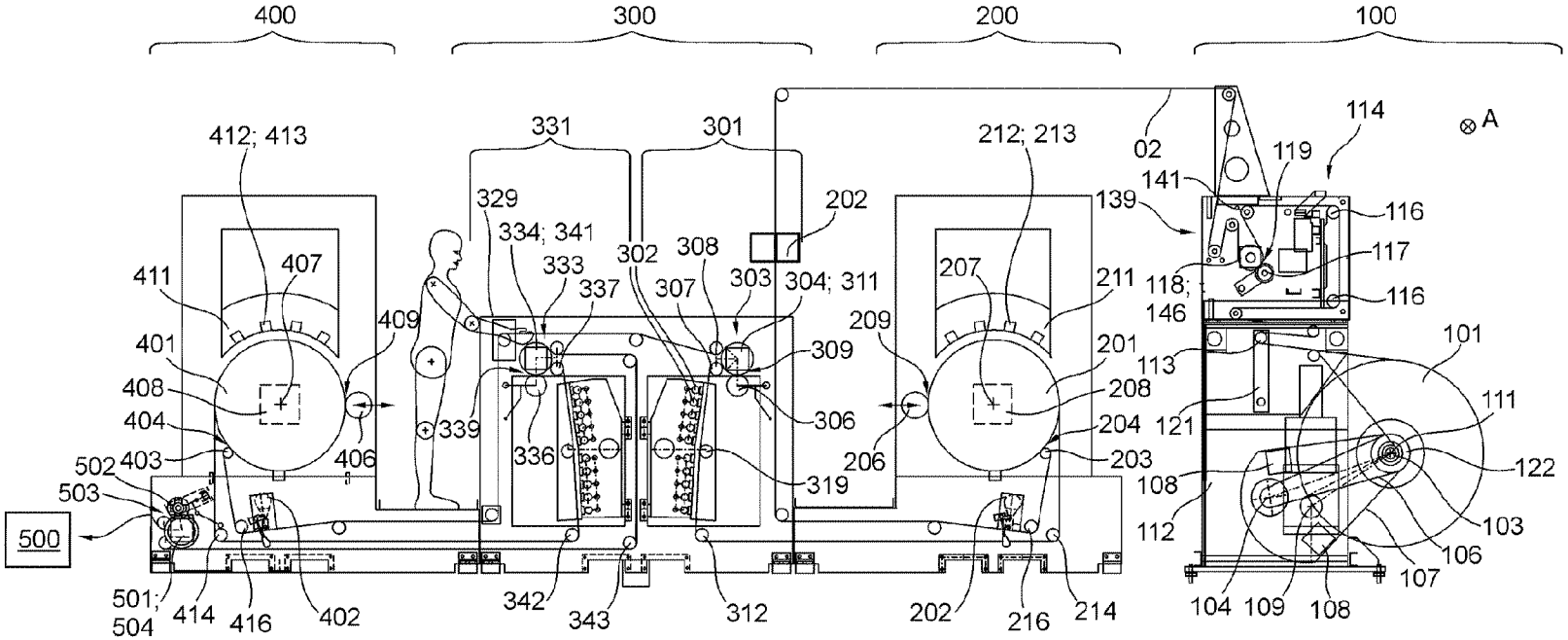
FIG. 1*a* a schematic diagram of a web-fed printing press.
Figure 1B:
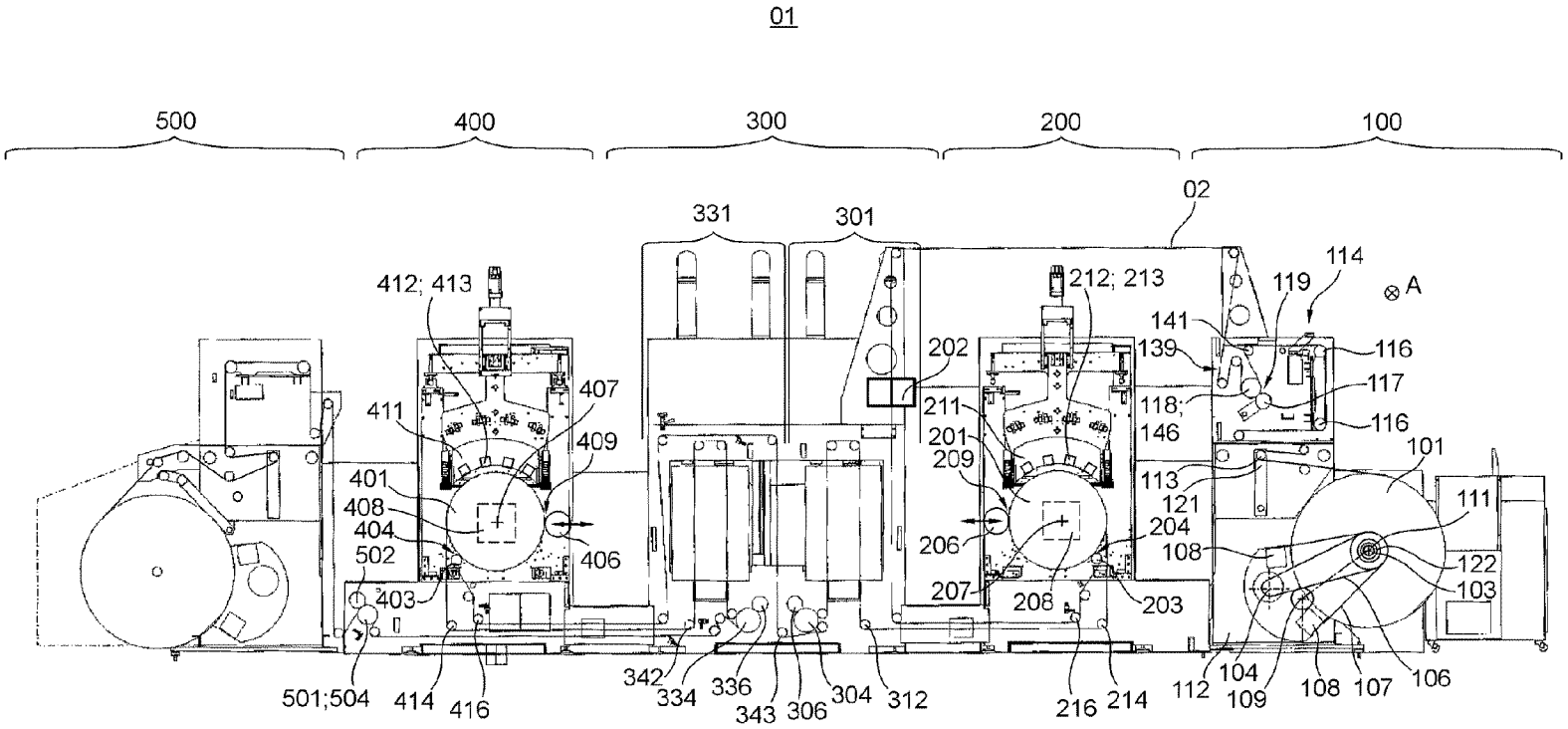
FIG. 1*b* a schematic diagram of a web-fed printing press having an alternate web path.
Figure 2:
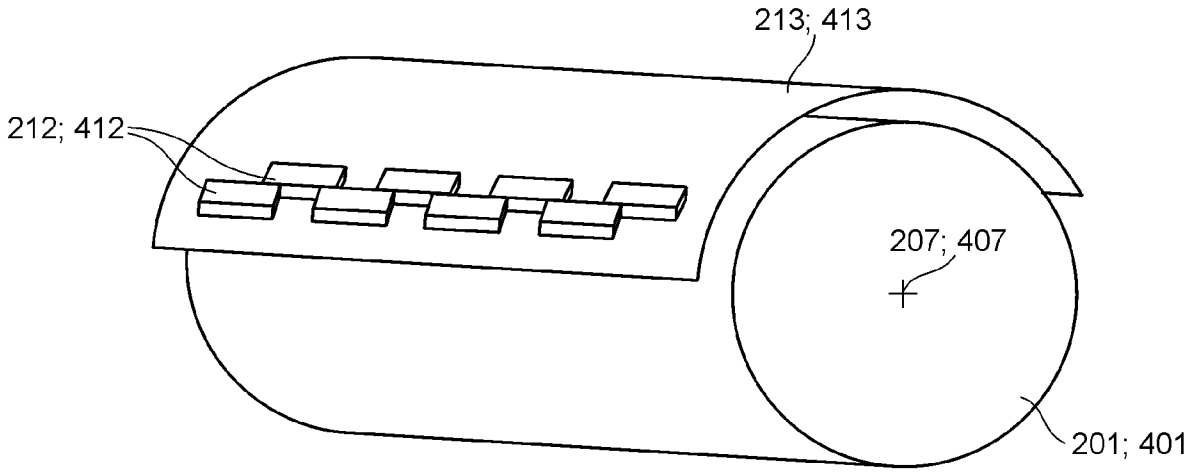
FIG. 2 a schematic diagram of a part of a printing unit, which has a double row of print heads.
Figure 3:
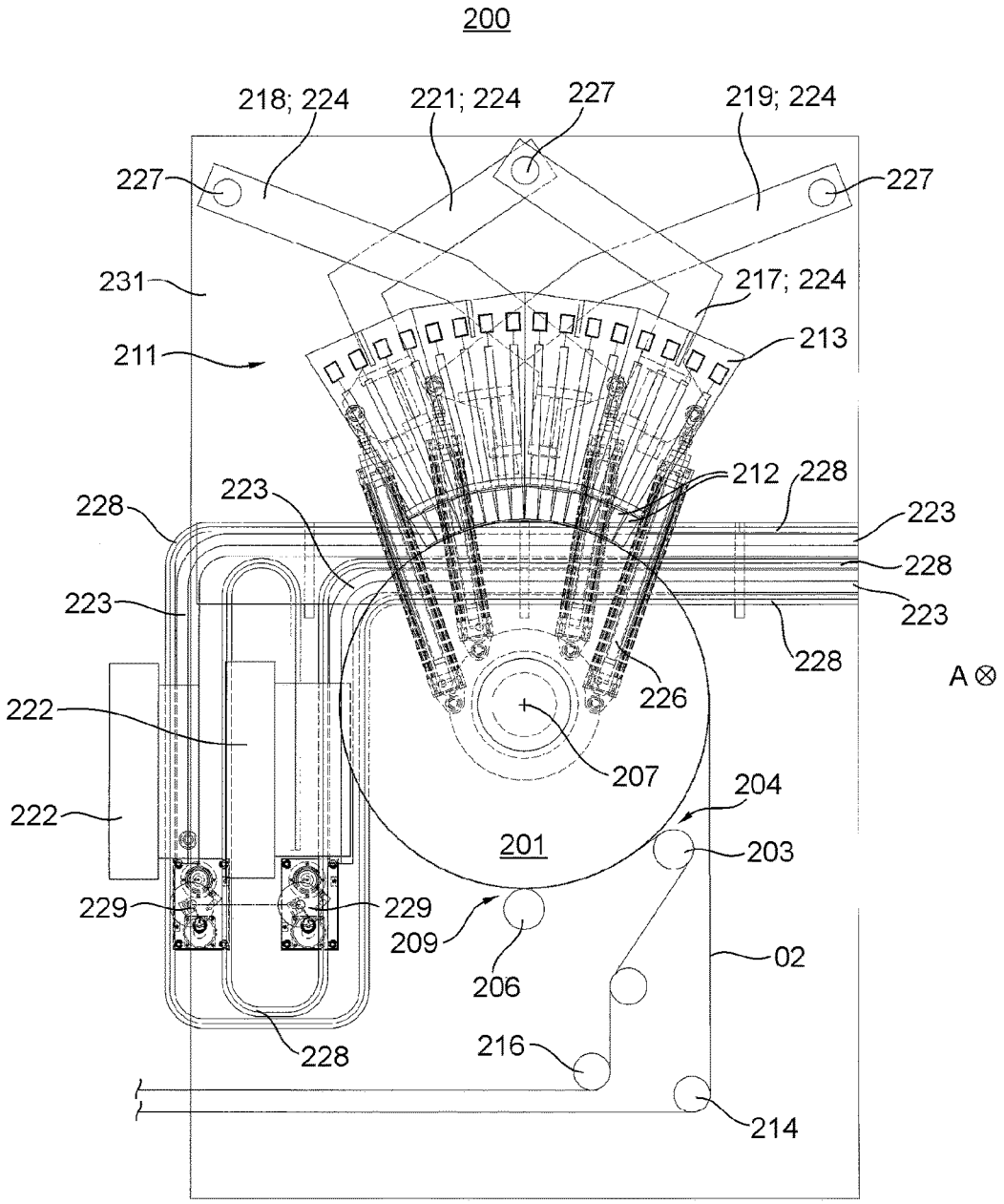
FIG. 3 a schematic diagram of a printing unit having a plurality of nozzle bars, the print heads of which are arranged in printing positions.
Figure 4:
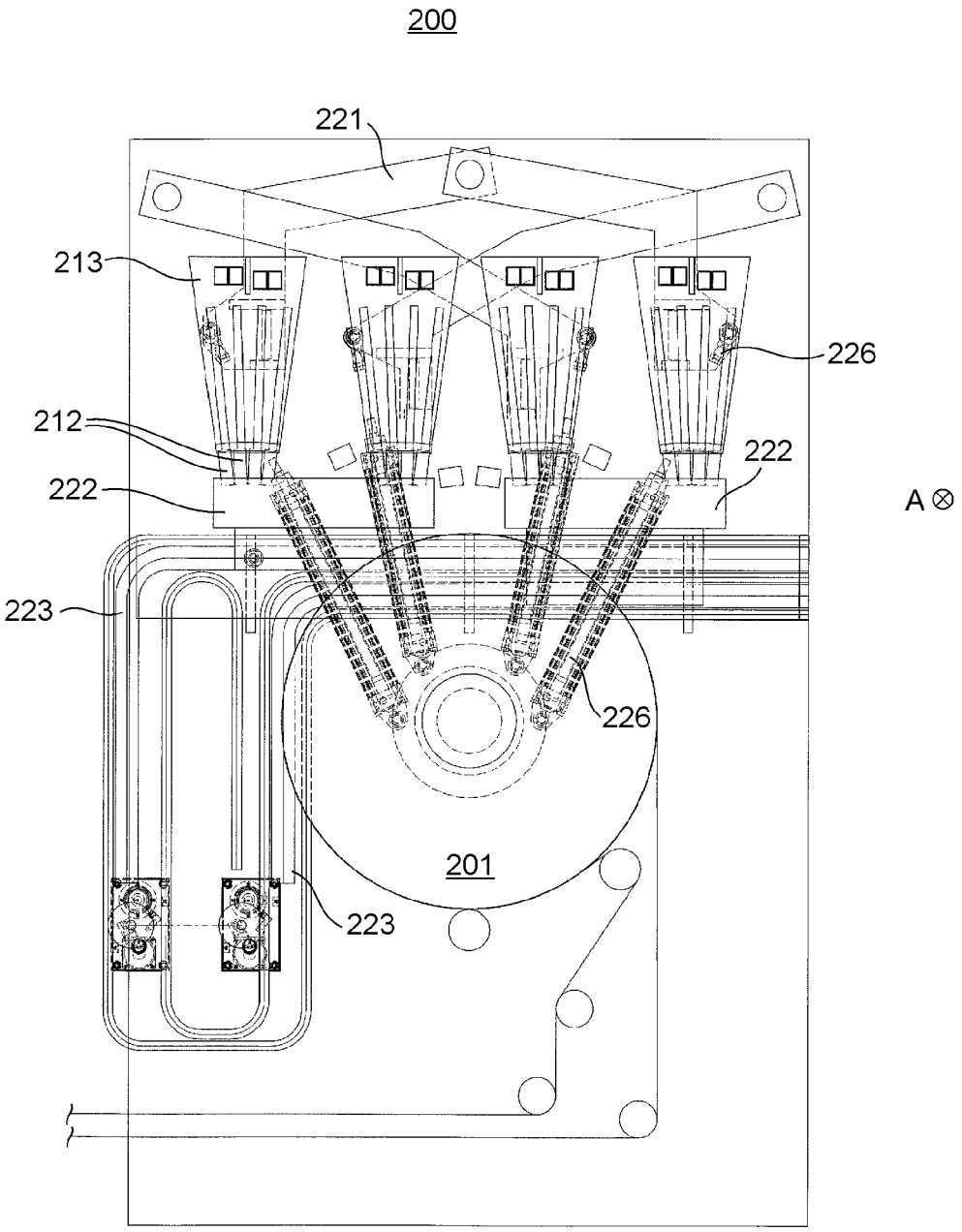
FIG. 4 a schematic diagram of a printing unit having a plurality of nozzle bars, the print heads of which are arranged in idle positions, in particular maintenance positions, with positioning drives depicted as discontinuous for the sake of clarity.
Figure 5:
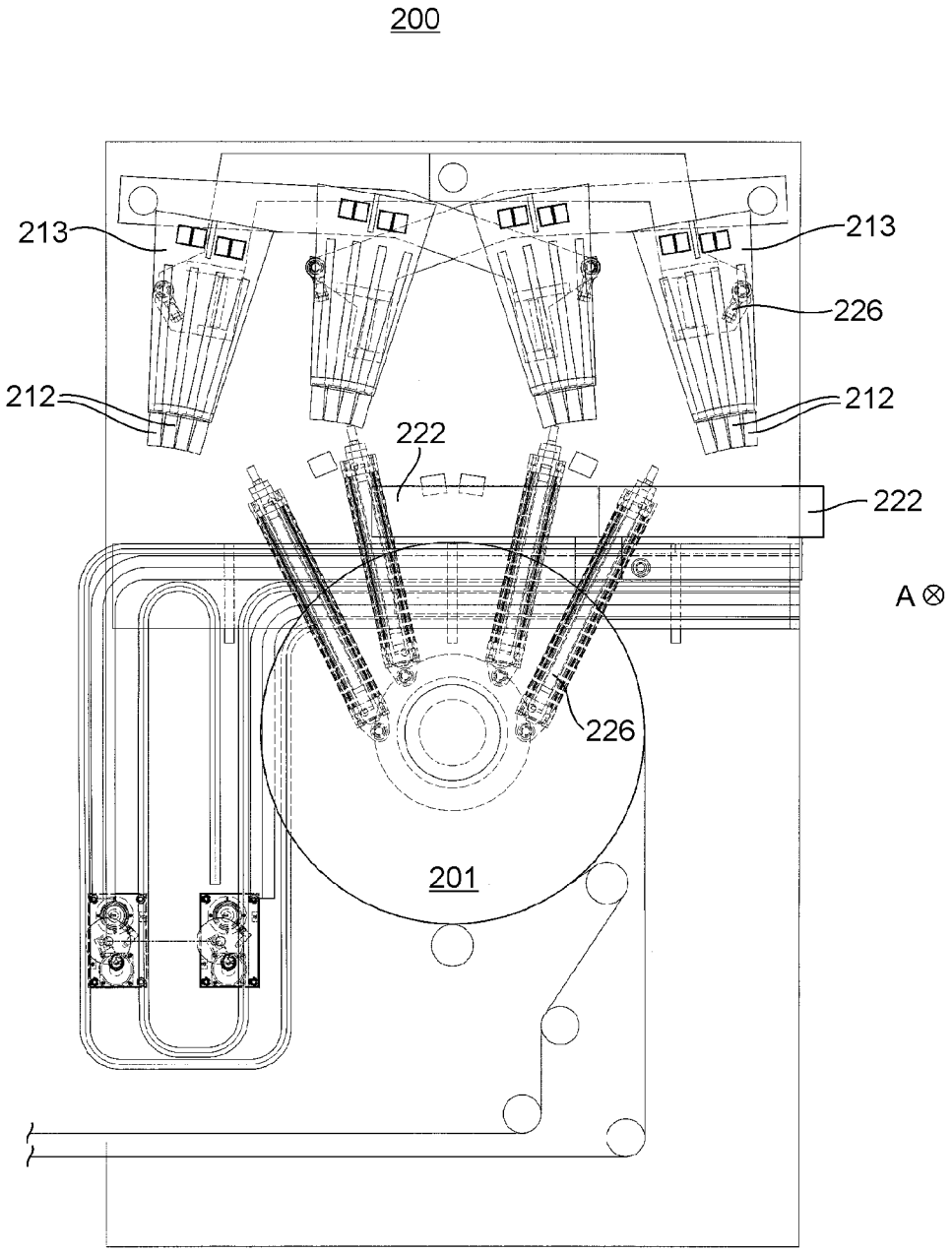
FIG. 5 a schematic diagram of a printing unit having a plurality of nozzle bars, the print heads of which are arranged in idle positions, in particular assembly positions, with positioning drives depicted as discontinuous for the sake of clarity.
Figure 6:
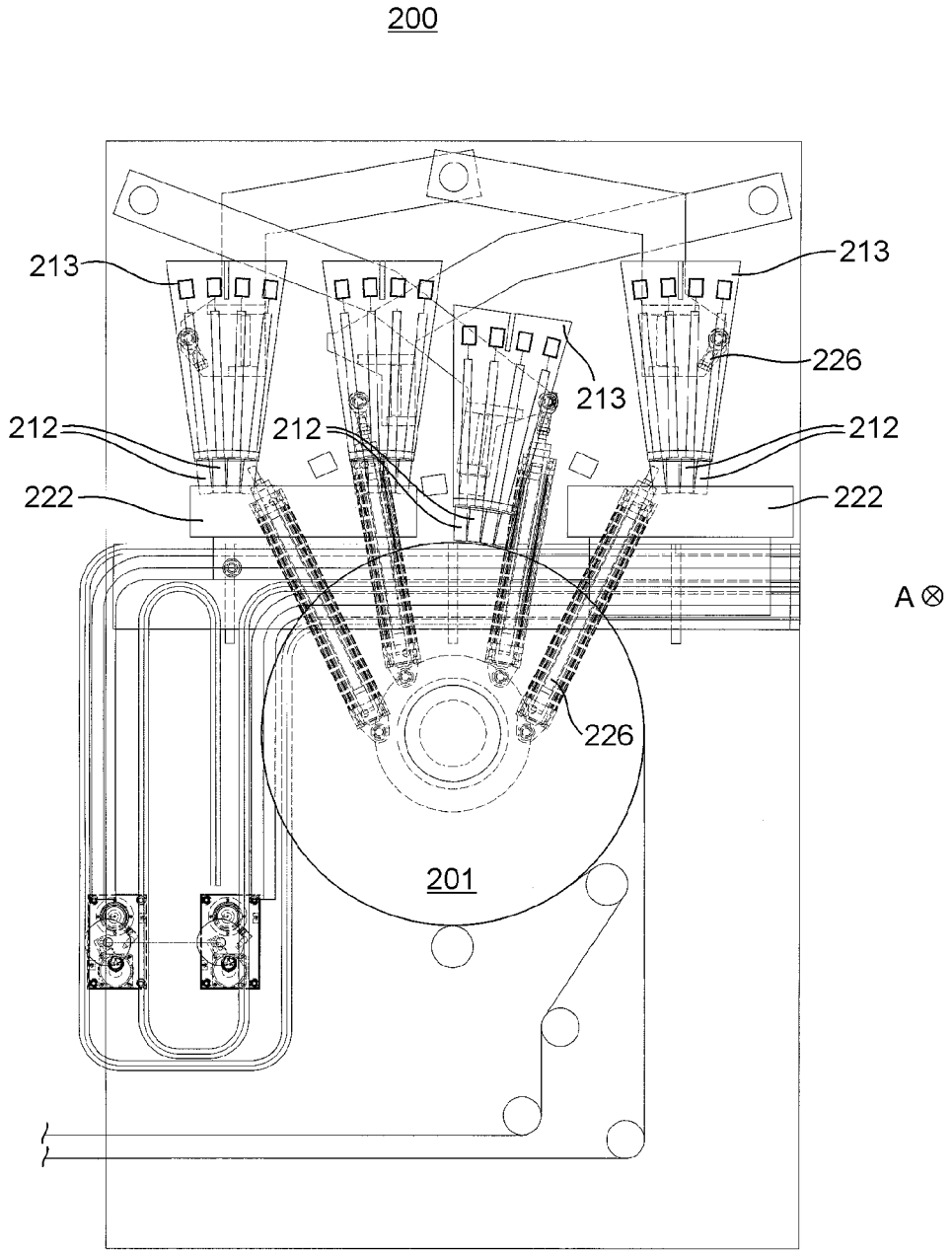
FIG. 6 a schematic diagram of a printing unit having a plurality of nozzle bars, the print heads of which are arranged some in idle positions, in particular maintenance positions, and some in printing positions, with positioning drives depicted as discontinuous for the sake of clarity.
Figure 7A:
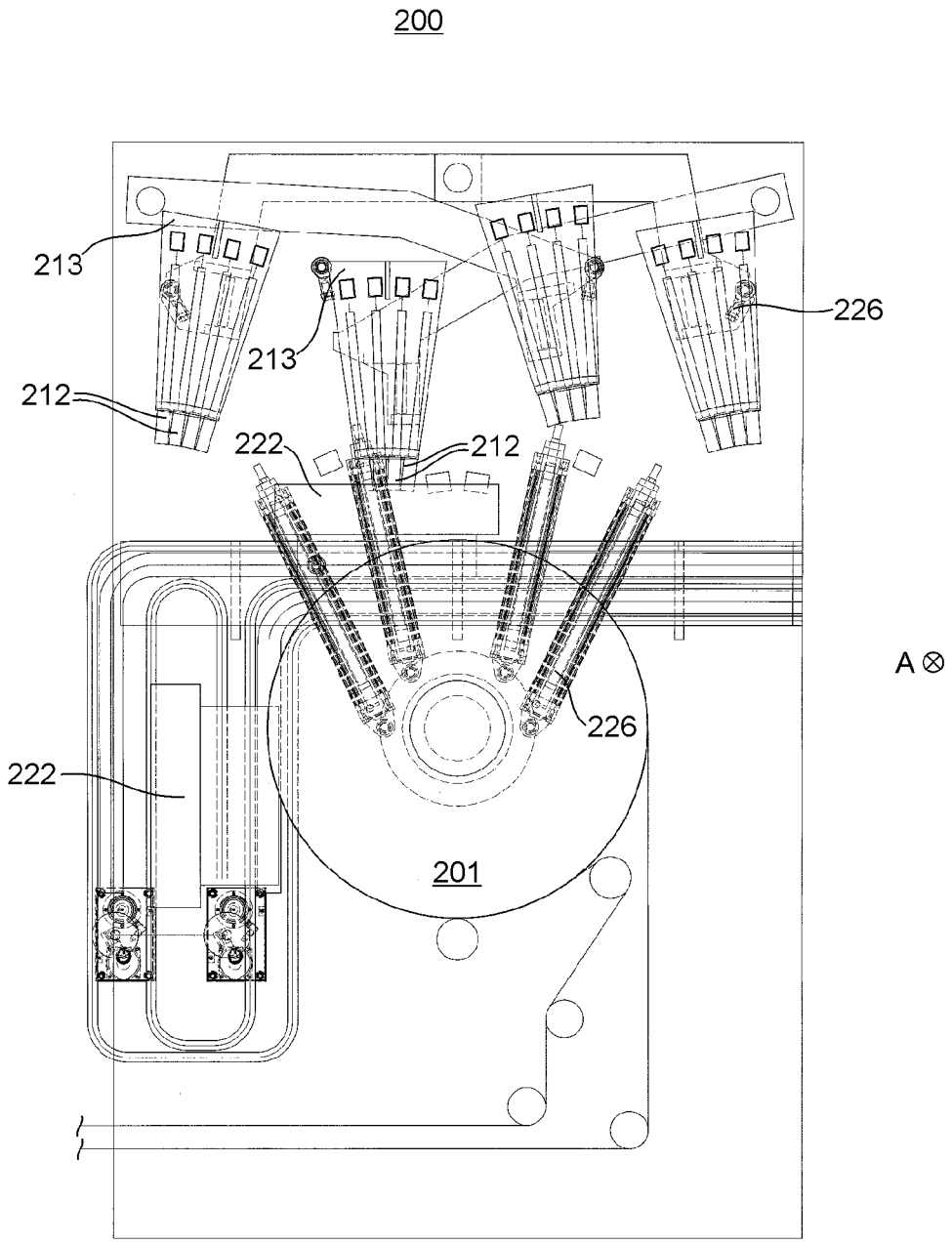
FIG. 7*a* a schematic diagram of a printing unit having a plurality of nozzle bars, the print heads of which are arranged some in maintenance positions and some in assembly positions, with positioning drives depicted as discontinuous for the sake of clarity.
Figure 7B:
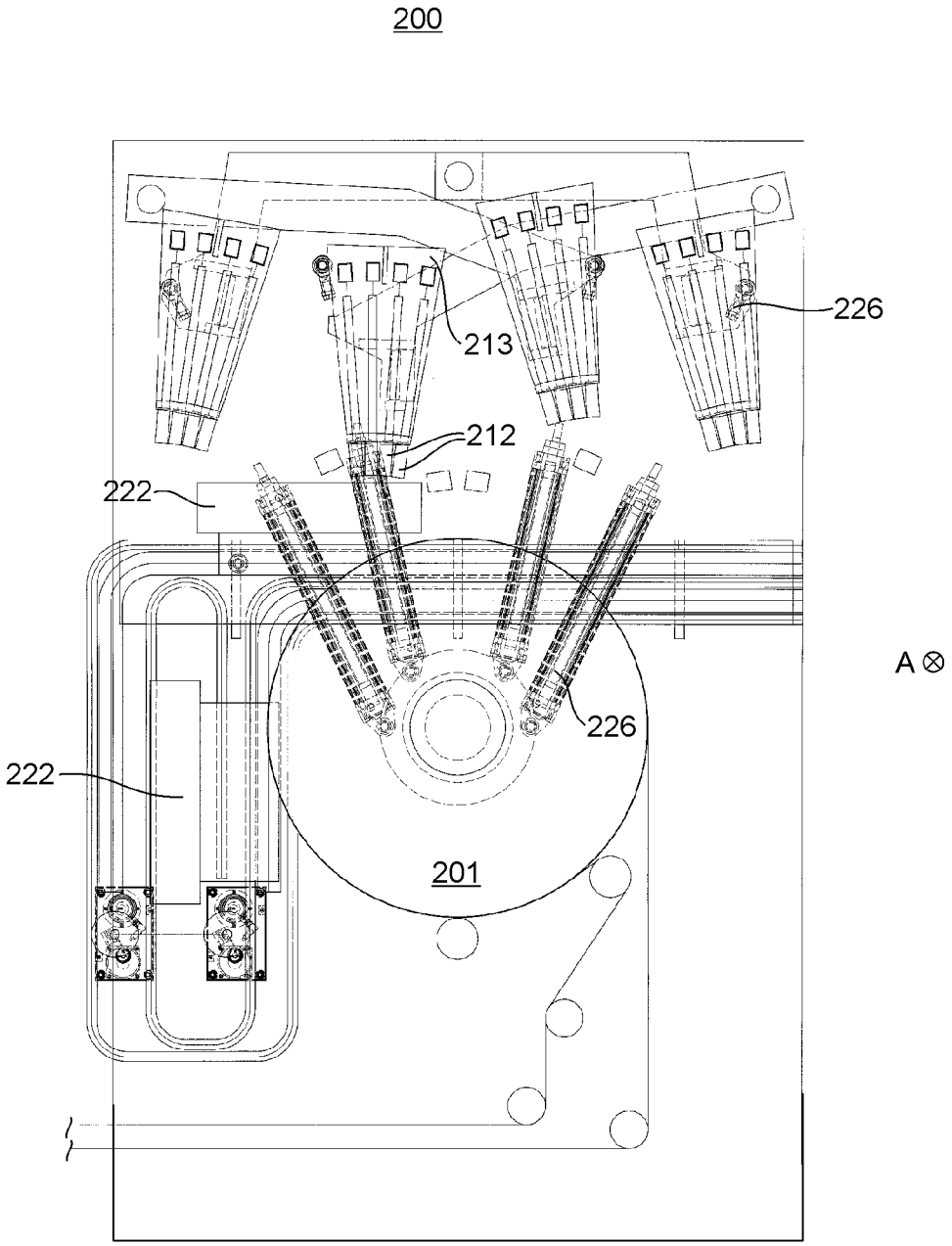
FIG. 7*b* a schematic diagram of a printing unit having a plurality of nozzle bars, with positioning drives depicted as discontinuous for the sake of clarity.
Figure 7C:
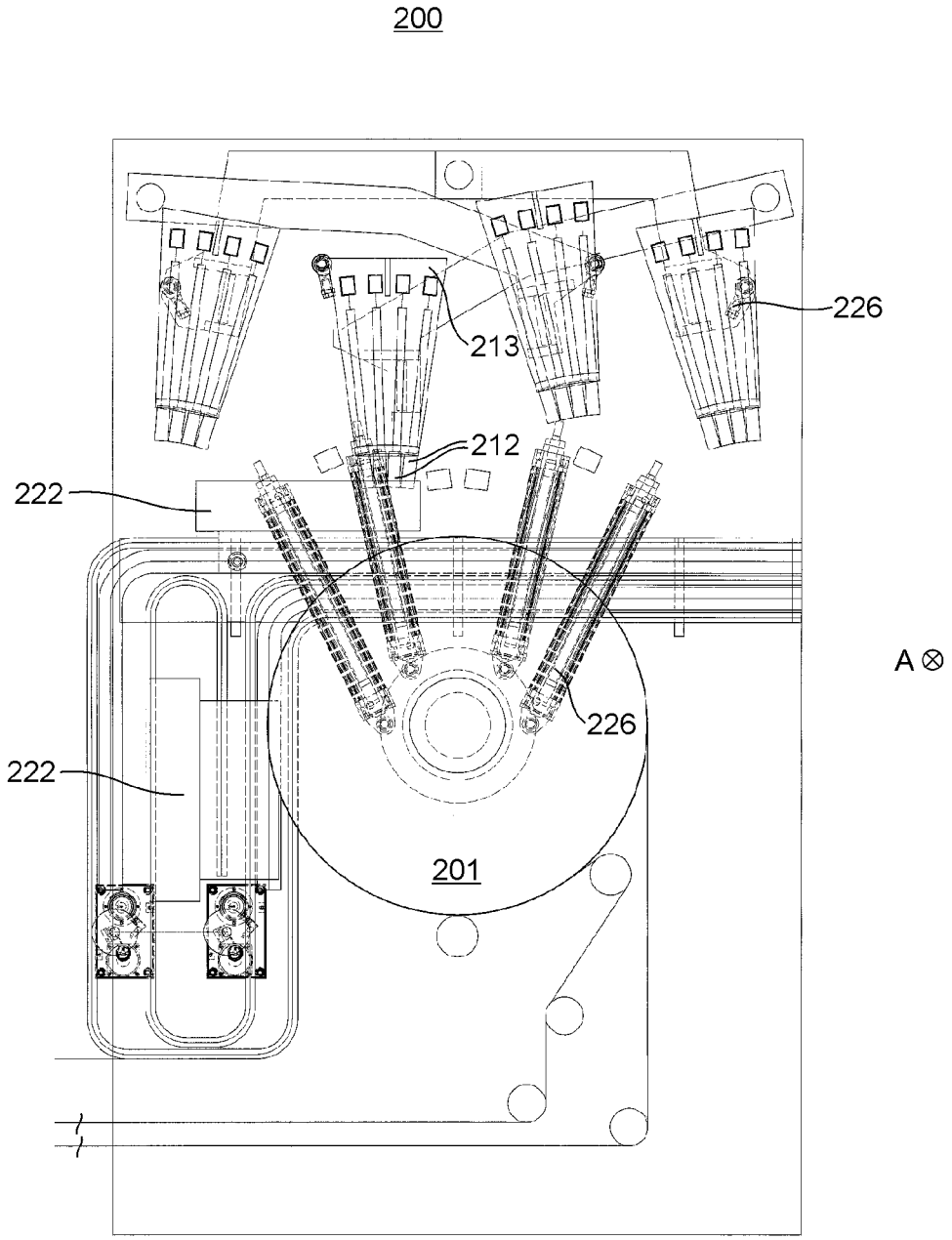
FIG. 7*c* a schematic diagram of a printing unit having a plurality of nozzle bars, with positioning drives depicted as discontinuous for the sake of clarity.

A printing press 01 comprises at least one printing material source 100, at least one first printing unit 200, preferably at least one first dryer 301, preferably at least one second printing unit 400 and preferably at least one second dryer 331, and preferably at least one post-processing unit 500. Printing press 01 is further preferably embodied as an inkjet printing press 01. Printing press 01 is preferably embodied as a web-fed printing press 01, and more preferably as a web-fed inkjet printing press 01. Printing press 01 is embodied, for example, as a rotary printing press 01, for example as a web-fed rotary printing press 01, in particular a web-fed rotary inkjet printing press 01. In the case of a web-fed printing press 01, printing material source 100 is embodied as a roll unwinding device 100. In the case of a sheet-fed printing press or a sheet-fed rotary printing press, printing material source 100 is embodied as a sheet feeder. In printing material source 100, at least one printing material 02 is preferably aligned, preferably with respect to at least one edge of said printing material 02. In the roll unwinding device 100 of a web-fed printing press 01, at least one web-type printing material 02, that is, a printing material web 02, for example, a paper web 02 or a textile web 02 or a film 02, for example a plastic film 02 or a metal film 02, is unwound from a roll of printing material 101 and is preferably aligned with respect to its edges in an axial direction A. Axial direction A is preferably a direction A that extends parallel to a rotational axis 111 of a roll of printing material 101 and/or at least one printing material guiding element 201; 401, for example at least one central cylinder 201; 401. A transport path of the at least one printing material 02 and particularly of printing material web 02 downstream of the at least one printing material source 100 preferably extends through the at least one first printing unit 200, where printing material 02 and particularly printing material web 02 is provided with a printed image, preferably by means of at least one printing ink, at least on one side, and in combination with the at least one second printing unit 400, preferably on both sides.

After passing through the at least one first printing unit 200, the transport path of printing material 02 and particularly of printing material web 02 preferably passes through the at least one first dryer 301, where the applied printing ink is dried. Printing ink in the above and in the following is generally understood as a coating medium, including particularly varnish. More particularly, no differentiation is made between printing ink and ink; printing ink and coating medium are also understood to include particularly ink. The at least one first dryer 301 is preferably a component of a dryer unit 300. After passing through the at least one first dryer 301 and preferably the at least one second printing unit 400 and/or the at least one second dryer 331, printing material 02 and particularly printing material web 02 is preferably fed to the at least one post-processing unit 500, where it is further processed. The at least one post-processing unit 500 is embodied, for example, as at least one folding apparatus 500 and/or as a winding apparatus 500 and/or as at least one planar delivery unit 500. In the at least one folding apparatus 500, printing material 02, preferably imprinted on both sides, is preferably further processed to produce individual printed products. Preferably, along the transport path of printing material 02 and particularly of printing material web 02 through printing press 01, at least the first dryer 301 is preferably arranged downstream of the at least one first printing unit 200, and/or at least the second printing unit 400 is preferably arranged downstream of the at least one first dryer 301, and/or the at least one second dryer 331 is preferably arranged downstream of the at least one second printing unit 400, and/or the at least one post-processing unit 500 is preferably arranged downstream of the at least one second dryer 331. This serves to ensure capability for high quality double-sided imprinting of printing material 02 and particularly of printing material web 02.

In the following, a web-fed printing press 01 will be described in greater detail. Corresponding specifics can be applied likewise to other printing presses 01, for example to sheet-fed printing presses, where such specifics are not incompatible. Rolls of printing material 101, which are preferably used in roll unwinding device 100, preferably each have a core onto which web-type printing material 02 for use in web-fed printing press 01 is wound. Printing material web 02 preferably has a width of 700 mm to 2000 mm, but can also have any smaller or preferably greater width. At least one roll of printing material 101 is rotatably arranged in roll unwinding device 100. In a preferred embodiment, roll unwinding device 100 is configured suitably for receiving one roll of printing material 101, and thus has only one storage position for a roll of printing material 101. In another embodiment, roll unwinding device 100 is embodied as roll changer 100 and has storage positions for at least two rolls of printing material 101. Roll changer 100 is preferably embodied to enable a flying roll change, that is, a splicing of a first printing material web 02 of a roll of printing material 101 currently being processed to a second printing material web 02 of a roll of printing material 101 to be subsequently processed while both the roll of printing material 101 currently being processed and the roll of printing material 101 to be subsequently processed are in rotation.

A working width of printing press 01 is a dimension that preferably extends orthogonally to the provided transport path of printing material 02 through the at least one first printing unit 200, more preferably in axial direction A. The working width of printing press 01 preferably corresponds to a maximum allowable width of a printing material for processing in printing press 01, that is, a maximum printing material width that can be processed in printing press 01.

Roll unwinding device 100 preferably has at least one roll holding device 103, embodied as a chucking device 103 and/or as a clamping device 103, for example, for each storage position. The at least one roll holding device 103 preferably represents at least one first motor-driven rotational body 103. The at least one roll holding device 103 rotatably secures at least one roll of printing material 101. The at least one roll holding device 103 preferably has at least one drive motor 104.

Along the transport path of printing material web 02 downstream of roll holding device 103, roll unwinding device 100 preferably has a dancer roller 113, preferably arranged to swivel outward on a dancer lever 121, and/or a first web edge aligner 114, and/or an infeed unit 139, which has an infeed nip 119 formed by a traction roller 118 and a traction pressure roller 117, and has a first measurement device 141, embodied as a first measuring roller 141, particularly as a nip measuring roller 141. Said traction roller 118 preferably has its own drive motor 146, embodied as a tractive drive motor 146, which is preferably connected to a machine controller. Traction roller 118 preferably represents at least one second motor-driven rotational body 118. A web tension can be adjusted and held within limits by means of the dancer roller 113, and/or the web tension is preferably held within limits. Roll unwinding device 100 optionally has a splicing and cutting device, by means of which a roll change can be carried out on a flying basis, i.e. without stopping the printing material web 02.

Infeed unit 139 is preferably arranged downstream of the first web edge aligner 114. The at least one traction roller 118 is preferably provided as a component of infeed unit 139, and preferably cooperates with traction pressure roller 117 to form infeed nip 119. Infeed nip 119 serves to control a web tension and/or to transport printing material 02. The web tension can preferably be measured by means of the at least one first measuring device 141, embodied as first measuring roller 141. The at least one first measuring device 141, embodied as first measuring roller 141, is preferably arranged upstream of infeed nip 119 in the direction of transport of printing material web 02.

A first printing unit 200 is arranged downstream of roll unwinding device 100 along the transport path of printing material 02. First printing unit 200 has at least one printing material guiding element 201. The at least one printing material guiding element 201 is preferably embodied as at least one first central printing cylinder 201, or central cylinder 201. In the following, when a central cylinder 201 is mentioned, a central printing cylinder 201 is always meant. The at least one first central cylinder 201 preferably represents at least one third motor-driven rotational body 201. During printing operation, printing material web 02 wraps at least partially around first central cylinder 201. The wrap angle in this case is preferably at least 180° and more preferably at least 270°. The wrap angle is the angle, measured in the circumferential direction, of the circumferential cylinder surface of first central cylinder 201 along which printing material 02, and particularly printing material web 02, is in contact with first central cylinder 201. Therefore, during printing operation, as viewed in the circumferential direction, preferably at least 50% and more preferably at least 75% of the circumferential cylinder surface of first central cylinder 201 is in contact with printing material web 02. This means that a partial surface area of a circumferential cylinder surface of the at least one first central cylinder 201, provided as the contact surface between the at least one first central cylinder 201 and printing material 02, preferably embodied as printing material web 02, has the wrap angle around the at least one first central cylinder 201 that preferably measures at least 180° and more preferably at least 270°.

Along the transport path of printing material web 02, upstream of first central cylinder 201 of first printing unit 200, at least one second measuring device 216, preferably embodied as a second measuring roller 216, is provided for measuring web tension. Along the transport path of printing material web 02, upstream of first central cylinder 201 of first printing unit 200, at least a first printing material preparation device 202 or web preparation device 202 is preferably arranged so as to act on printing material web 02 and/or as aligned toward the provided transport path of printing material web 02. The first printing material preparation device 202 is assigned at least to a first side and preferably to both sides of printing material web 02, and is particularly aligned to act or be capable of acting at least on this first side of printing material web 02 and preferably on both sides of printing material web 02. Infeed nip 119 formed by traction roller 118 and traction pressure roller 117 is preferably arranged between first web edge aligner 114 and the at least one first central cylinder 201 along the transport path of printing material web 02.

In a preferred embodiment, the at least one first printing material preparation device 202 is arranged downstream of infeed nip 119 and upstream of first central cylinder 201 along the transport path of printing material web 02, acting on printing material web 02 and/or aligned toward the transport path of printing material web 02. The at least one first printing material preparation device 202 is preferably embodied as at least one printing material cleaning device 202 or web cleaning device 202. Alternatively or additionally, the at least one printing material preparation device 202 is embodied as at least one coating device 202, particularly for water-based coating medium. A coating of this type is used, for example, as a base coat (primer). Alternatively or additionally, the at least one printing material preparation device 202 is embodied as at least one corona device 202 and/or discharge device 202 for corona treatment of printing material 02.

A roller 203, embodied as a first turning roller 203 of first printing unit 200, is preferably arranged with its rotational axis parallel to the first central cylinder 201. This first turning roller 203 is preferably arranged spaced from first central cylinder 201. In particular, a first gap 204, which is greater than the thickness of printing material web 02, is preferably provided between first turning roller 203 and first central cylinder 201. The thickness of printing material web 02 in this context is understood as the smallest dimension of printing material web 02. Printing material web 02 preferably wraps around part of the first turning roller 203 and is turned by said roller such that the transport path of printing material web 02 in first gap 204 extends both tangentially to first turning roller 203 and tangentially to first central cylinder 201. The circumferential surface of turning roller 203 in this case is preferably made of a relatively inelastic material, more preferably of a metal, even more preferably of steel or aluminum.

At least one first cylinder 206, embodied as first impression cylinder 206, is preferably provided in first printing unit 200. First impression cylinder 206 preferably has a circumferential surface made of an elastic material, for example an elastomer. First impression cylinder 206 is preferably arranged such that it can be thrown on and/or thrown off of first central cylinder 201 by means of an actuating drive. In a state in which it is thrown onto first central cylinder 201, first impression cylinder 206, together with first central cylinder 201, preferably forms a first impression nip 209. During printing operation, printing material web 02 preferably passes through first impression nip 209. By means of first turning roller 203 and/or preferably by means of first impression cylinder 206, printing material web 02 is preferably placed in planar contact, and more preferably in a specific and known position, against first central cylinder 201. Preferably, apart from first impression cylinder 206 and/or optionally additional impression cylinders, no additional rotational elements, in particular no additional roller and no additional cylinder, is in contact with the at least one first central cylinder 201. The rotational axis of first impression cylinder 206 is preferably arranged below rotational axis 207 of first central cylinder 201.

First central cylinder 201 preferably has its own first drive motor 208, assigned to first central cylinder 201, which drive motor is preferably embodied as an electric motor 208 and is more preferably embodied as a direct drive 208 and/or an independent drive 208 of first central cylinder 201. A direct drive 208 in this case is understood as a drive motor 208 which is connected to the at least one first central cylinder 201 so as to transmit torque or be capable of transmitting torque, without interconnection of additional rotational elements that are in contact with printing material 02. An independent drive 208 in this context is understood as a drive motor 208 which is embodied as the drive motor 208 exclusively of the at least one first central cylinder 201. First drive motor 208 of first central cylinder 201 preferably has at least one permanent magnet, which further preferably is part of a rotor of first drive motor 208 of first central cylinder 201.

On first drive motor 208 of first central cylinder 201 and/or on first central cylinder 201 itself, a first rotational angle sensor is preferably provided, which is embodied to measure and/or be capable of measuring an angular position of first drive motor 208 and/or of first central cylinder 201 itself, and to transmit and/or be capable of transmitting said measurement to a higher level machine controller. The first rotational angle sensor is embodied, for example, as a rotation encoder or absolute value encoder. A rotational angle sensor of this type can be used to determine in absolute terms the angular position of first drive motor 208 and/or preferably the angular position of first central cylinder 201, preferably by means of the higher level machine controller. Additionally or alternatively, first drive motor 208 of first central cylinder 201 is connected in terms of circuitry to the machine controller such that the machine controller is informed at all times regarding the angular position of first drive motor 208 and therefore at the same time regarding the angular position of first central cylinder 201, on the basis of target data relating to the angular position of first drive motor 208, predefined by the machine controller to first drive motor 208 of first central cylinder 201. In particular, a region of the machine controller that specifies the rotational angle position or angular position of first central cylinder 201 and/or of first drive motor 201 is preferably connected directly, in particular without an interconnected sensor, to a region of the machine controller that controls at least one print head 212 of first printing unit 200.

At least one first printing element 211 is arranged inside first printing unit 200. The at least one first printing element 211 is preferably arranged downstream of first impression cylinder 206 in the direction of rotation of first central cylinder 201 and therefore along the transport path of printing material web 02, preferably so as to act and/or be capable of acting on, and/or as aligned and/or capable of being aligned toward the at least one first central cylinder 201. The at least one first printing element 211 is embodied as a first inkjet printing element 211, and is also referred to as first inkjet printing element 211. First printing element 211 preferably has at least one nozzle bar 213 and preferably a plurality of nozzle bars 213, in particular four. The at least one first printing element 211, and therefore the at least one first printing unit 200, preferably comprises the at least one first print head 212, which is embodied as inkjet print head 212. Each at least one nozzle bar 213 has at least one print head 212 and preferably a plurality of print heads 212. Each print head 212 preferably has a plurality of nozzles, from which droplets of printing ink are and/or can be ejected. A nozzle bar 213 in this case is a component that preferably extends across at least 80% and more preferably at least 100% of the working width of printing press 01 and serves as a support for the at least one print head 212. The axial length of the body of the at least one first central cylinder 201 is preferably at least as great as the working width of printing press 01. A single nozzle bar or a plurality of nozzle bars 213 is/are provided per printing element 211. Each nozzle is preferably assigned a clearly defined target region 608 with respect to direction A of the width of printing material web 02 and preferably with respect to direction A particularly of rotational axis 207 of the at least one first central cylinder 201. Each target region 608 of a nozzle, particularly with respect to the circumferential direction of the at least one first central cylinder 201, is preferably clearly defined, at least during printing operation. A target region 608 of a nozzle is particularly the spatial region, particularly substantially rectilinear, that extends outward from said nozzle in an ejecting direction of said nozzle as depicted schematically in FIG. 10.

The at least one first nozzle bar 213 preferably extends orthogonally to the transport path of printing material 02 across the working width of printing press 01. The at least one nozzle bar 213 preferably has at least one row of nozzles. The at least one row of nozzles, as viewed in axial direction A, preferably has nozzle openings spaced evenly across the entire working width of printing press 01 and/or across the entire width of the body of the at least one first central cylinder 201. In one embodiment, a single continuous print head 212 is provided for this purpose, which extends in axial direction A across the entire working width of printing press 01 and/or across the entire width of the body of the at least one first central cylinder 201. In this case, the at least one row of nozzles is preferably embodied as at least one linear row of individual nozzles, extending across the entire width of printing material web 02 in axial direction A. In another preferred embodiment, a plurality of print heads 212 are arranged side by side in axial direction A on the at least one nozzle bar 213. Since such individual print heads 212 are usually not equipped with nozzles up to the edges of their housing, preferably at least two and more preferably precisely two rows of print heads 212, extending in axial direction A, are preferably arranged offset from one another in the circumferential direction of first central cylinder 201, preferably such that successive print heads 212 in axial direction A are preferably assigned alternatingly to one of the at least two rows of print heads 212, preferably alternating constantly between a first and a second of two rows of print heads 212. Two such rows of print heads 212 form a double row of print heads 212. The at least one row of nozzles is preferably not embodied as a single linear row of nozzles, and instead results as the sum of a plurality of individual rows of nozzles, more preferably two, arranged offset from one another in the circumferential direction.

If a print head 212 has a plurality of nozzles, all the target regions of the nozzles of said print head 212 together form an operating region of said print head 212. Operating regions of print heads 212 of a nozzle bar 213 and particularly of a double row of print heads 212 border one another as viewed in axial direction A and/or overlap as viewed in axial direction A. This serves to ensure that target regions of nozzles of the at least one nozzle bar 213 and/or particularly of each double row of print heads 212 are spaced at regular and preferably periodic distances, as viewed in axial direction A, even if print head 212 is not continuous in axial direction A. In any case, an entire operating region of the at least one nozzle bar 213 preferably extends across at least 90% and more preferably across 100% of the working width of printing press 01 and/or across the entire width of the body of the at least one first central cylinder 201 in axial direction A. On one or on both sides with respect to axial direction A, a narrow region of printing material web 02 and/or of the body of first central cylinder 201 may be provided which is not assigned to the operating region of nozzle bar 213. An entire operating region of the at least one nozzle bar 213 is preferably composed of all the operating regions of the print heads 212 of said at least one nozzle bar 213 and is preferably composed of all the target regions of nozzles of said print heads 212 of said at least one nozzle bar 213. An entire operating region of a double row of print heads 212, as viewed in axial direction A, preferably corresponds to the operating region of the at least one nozzle bar 213.

The at least one nozzle bar 213 preferably has a plurality of rows of nozzles in the circumferential direction with respect to the at least one first central cylinder 201. Preferably, each print head 212 has a plurality of nozzles, which are further preferably arranged in a matrix of a plurality of lines in axial direction A and/or a plurality of columns, preferably in the circumferential direction of the at least one first central cylinder 201, with columns of this type more preferably being arranged extending at an angle relative to the circumferential direction, for example in order to increase the resolution of a printed image. In a direction orthogonally to axial direction A, particularly in the transport direction along the transport path of printing material 02 and/or in the circumferential direction with respect to the at least one central cylinder 201, preferably a plurality of rows of print heads 212, more preferably four double rows, and even more preferably eight double rows of print heads 212 are arranged in succession. Further preferably, at least during printing operation, a plurality of rows of print heads 212, more preferably four double rows, and even more preferably eight double rows of print heads 212 are arranged in succession in the circumferential direction with respect to the at least one first central cylinder 201, aligned toward the at least one first central cylinder 201.

Thus at least during printing operation, print heads 212 are preferably aligned such that the nozzles of each print head 212 point substantially in the radial direction toward the circumferential cylinder surface of the at least one first central cylinder 201. Deviations of radial directions within a tolerance range of preferably 10° at most and more preferably 5° at most are considered substantially radial directions. This means that the at least one print head 212, aligned toward the circumferential surface of the at least one first central cylinder 201, is aligned with respect to rotational axis 207 of the at least one first central cylinder 201 in a radial direction toward the circumferential surface of the at least one first central cylinder 201. Said radial direction is a radial direction with respect to rotational axis 207 of the at least one first central cylinder 201. A printing ink of a specific color, for example one each of the colors black, cyan, yellow and magenta, or a varnish, for example a clear varnish, preferably is and/or can be assigned to each double row of print heads 212. The corresponding inkjet printing element 211 is preferably embodied as a four-color printing element 211, and enables single-sided, four-color imprinting of printing material web 02. It is also possible to use one printing element 211 to print with fewer or more different ink colors, for example additional special ink colors. In that case, correspondingly more or fewer print heads 212 and/or double rows of print heads 212 are preferably arranged within said corresponding printing element 211. In one embodiment, at least during printing operation, a plurality of rows of print heads 212, more preferably four double rows and even more preferably eight double rows of print heads 212 are arranged in succession, aligned toward at least one surface of at least one transfer element, for example at least one transfer cylinder and/or at least one transfer belt.

The at least one print head 212 acts to generate droplets of printing ink, preferably using the drop-on-demand method, in which droplets of printing ink are produced selectively as needed. At least one piezoelectric element is preferably used per nozzle, which is capable of reducing a volume filled with printing ink by a certain percentage at high speed when a voltage is applied. This causes printing ink to be displaced and ejected through a nozzle connected to the volume that is filled with printing ink, forming at least one droplet of printing ink. By applying different voltages to the piezoelectric element, the actuating path of the piezoelectric element and as a result the reduction in the volume and thus the size of the printing ink droplets can be influenced. This allows color gradations to be achieved in the resulting printed image, without altering the number of droplets used to produce the printed image (amplitude modulation). It is also possible to use at least one heating element per nozzle, which generates a gas bubble at high speed in a volume filled with printing ink by vaporizing printing ink. The additional volume of the gas bubble displaces printing ink, which is in turn ejected through the corresponding nozzle, forming at least one droplet of printing ink.

In the drop-on-demand method, droplet deflection once a droplet has been ejected from the corresponding nozzle is not necessary, because the target position of the respective printing ink droplet on the moving printing material web 02 can be defined in relation to the circumferential direction of the at least one first central cylinder 201 based solely on an ejection time of the respective printing ink droplet and a rotational speed of first central cylinder 201 and/or based on the rotational position of first central cylinder 201. Actuating each nozzle individually allows printing ink droplets to be transferred only at selected times and at selected locations from the at least one print head 212 onto the printing material web 02. This is carried out as a function of the rotational speed and/or the rotational angle position of the at least one first central cylinder 201, the distance between the respective nozzle and printing material web 02 and the position of the target region of the respective nozzle in relation to the circumferential angle. This results in a desirable printed image, produced as a function of the actuation of all nozzles. Ink droplets are preferably ejected from the at least one nozzle of the at least one print head 212 based on the angular position of first drive motor 208, as predefined by the machine controller. The target data relating to the angular position of first drive motor 208, as specified by the machine controller to first drive motor 208, are preferably incorporated in real time into a calculation of data for actuating the nozzles of the at least one print head 212. A comparison with actual data regarding the angular position of first drive motor 208 is preferably not necessary, and preferably is not carried out. Thus a precise and constant positioning of printing material web 02 relative to the at least one first central cylinder 201 is critical for producing a printed image that is true to registration and/or register.

The nozzles of the at least one print head 212 are arranged in such a way that the distance between the nozzles and printing material web 02 arranged on the circumferential cylinder surface of the at least one first central cylinder 201, at least when print head 212 is arranged in a printing position, is preferably between 0.5 mm and 5 mm and more preferably between 1 mm and 1.5 mm. The high angular resolution and/or high scanning frequency of the rotational angle sensor and/or the high precision of the target data relating to the angular position of first drive motor 208 of first central cylinder 201, as predefined by the machine controller and processed by first drive motor 208 of first central cylinder 201, enable a highly precise position determination and/or knowledge of the location of printing material web 02 in relation to the nozzles and the target regions thereof. The droplet flight time between the nozzles and printing material web 02 is known, for example, from a learning process and/or from the known distance between the nozzles and printing material web 02 combined with a known droplet speed. The rotational angle position of the at least one first central cylinder 201 and/or of the first drive 208 of the at least one first central cylinder 201, the rotational speed of the at least one first central cylinder 201 and the droplet flight time are used to determine the ideal time for ejection of a respective droplet so that printing material web 02 will be imprinted in a manner that is true to registration and/or true to register.

At least one sensor embodied as a first printed image sensor is preferably provided, more preferably at a point along the transport path of printing material web 02 downstream of first printing element 211. The at least one first printed image sensor is embodied, for example, as a first line camera or as a first surface camera. The at least one first printed image sensor is embodied, for example, as at least one CCD sensor and/or as at least one CMOS sensor. The actuation of all the print heads 212 and/or double rows of print heads 212 of first printing element 211, arranged and/or acting in succession in the circumferential direction of the at least one first central cylinder 201, is preferably monitored and controlled by means of this at least one first printed image sensor and a corresponding analysis unit, for example the higher level machine controller. In a first embodiment of the at least one printed image sensor, only a first printed image sensor is provided, the sensor field of which encompasses the entire width of the transport path of printing material web 02. In a second embodiment of the at least one printed image sensor, only a first printed image sensor is provided, however it is embodied as movable in direction A, orthogonally to the direction of the transport path of printing material web 02. In a third embodiment of the at least one printed image sensor, a plurality of printed image sensors are provided, the respective sensor fields of which each encompass different regions of the transport path of printing material web 02. These regions are preferably arranged offset from one another in direction A, orthogonally to the direction of the transport path of printing material web 02. The total of the sensor fields of the plurality of printed image sensors preferably makes up one entire width of the transport path of printing material web 02.

The positioning of pixels formed by printing ink droplets, each of which emerges from a respective first print head 212, is preferably compared with the positioning of pixels formed by printing ink droplets, each of which emerges from a respective second print head 212 situated downstream of the respective first print head 212 in the circumferential direction of the at least one first central cylinder 201. This is preferably carried out regardless of whether said respective first and second print heads 212, which are arranged and/or act in succession in the circumferential direction of the at least one first central cylinder 201, are processing the same or a different printing ink. The correlation of the positions of the printed images coming from different print heads 212 is monitored. If the same printing inks are being used, the true-to-register joining of partial images is monitored. If different printing inks are being used, the registration or color registration is monitored. Quality control of the printed image is also preferably carried out based on the measured values of the at least one printed image sensor.

During regular printing operation, all print heads 212 are arranged as stationary. This serves to ensure a consistently true-to-registration and/or true-to-register alignment of all nozzles. Various situations are conceivable in which a movement of the print heads 212 might be necessary. A first such situation is a flying reel change or generally a reel change involving a splicing process. In such a process, one printing material web 02 is connected by means of an adhesive strip to another printing material web 02. This results in a spliced region, which must pass through the entire transport path of the printing material web 02. The thickness, that is, the smallest dimension of said spliced region is greater than the thickness of the printing material web 02. The spliced region has essentially the same thickness as two printing material webs 02 plus the adhesive strip. This can cause difficulties when the spliced region passes through the gap between the nozzles of print heads 212 and the circumferential cylinder surface of the at least one first central cylinder 201. Thus the at least one nozzle bar 213 can be moved in at least one actuating direction and/or along at least one actuating path relative to rotational axis 207 of the at least one first central cylinder 201. This allows the spacing to be increased sufficiently; however, it must be decreased again accordingly afterward. A second such situation arises, for example, during maintenance and/or cleaning of at least one of print heads 212. Print heads 212 are preferably secured individually to the at least one nozzle bar 213 and can be individually removed from the at least one nozzle bar 213. This allows individual print heads 212 to be maintained and/or cleaned and/or replaced.

When a plurality of nozzle bars 213 that can be moved relative to one another is provided, minimal misalignments of the nozzle bars 213 relative to one another can occur during the return of at least one nozzle bar 213 to its printing position. Thus it can be necessary to perform an alignment, specifically of all the print heads 212 of one nozzle bar 213 in relation to the print heads 212 of other nozzle bars 213. When a new print head 212 and/or a print head to be replaced is installed on the at least one nozzle bar 213 on which at least one other print head 212 is already installed, this will not necessarily produce a precisely matched alignment of this new print head 212 and/or print head to be replaced with the at least one print head 212 that is already installed, specifically in the circumferential direction and/or in axial direction A with respect to the at least one first central cylinder 201; at best, such an alignment will occur accidentally. Thus it may also be necessary to perform an alignment in this case, specifically of an individual print head 212 in relation to other print heads 212 of the same nozzle bar 213 and/or other nozzle bars 213.

At least one sensor preferably detects the location of the target region of at least one new and/or replaced print head 212 relative to the location of the target region of at least one previously mounted print head 212. The installed position of the at least one new and/or replaced print head 212 can be adjusted in the circumferential direction with respect to the at least one first central cylinder 201 by actuating the nozzles of said print head 212, preferably in a manner similar to the adjustment of print heads 212 of different double rows of print heads 212 already described. The installed position of the at least one new and/or replaced print head 212 is adjusted in axial direction A with respect to the at least one first central cylinder 201 by means of at least one adjustment mechanism. Preferably, each of a plurality of print heads 212 has its own adjustment mechanism, and more preferably, each print head 212 has its own adjustment mechanism.

Printing press 01 has at least one system 251 for supplying coating medium, in particular at least one printing ink supply system 251. Preferably, a plurality of print heads 212, for example a plurality of print heads 212 of a common nozzle bar 213, in particular a plurality of print heads 212 or more preferably all the print heads in each double row of print heads 212, have a common system 251 for supplying coating medium. The at least one supply system 251 and particularly the entire system 251 for supplying coating medium preferably has at least one main reservoir 252, in particular at least one main reservoir 252 for coating medium. At least one fluid line 253, preferably embodied as an ink line 253, per print head 212 is preferably connected to the at least one main reservoir 252. In particular, each of at least two print heads 212 preferably is and/or can be connected, via at least one first fluid line 253 each, preferably directly to the at least one main reservoir 252. The respective first fluid line 253 can be a flexible line, for example, in particular at least one hose. The at least one main reservoir 252 preferably is and/or can be connected via at least one supply line 254 and at least one drain line 256, directly or via interconnected components 263; 280; 285; 295, for example at least one second flow check valve 263 and/or at least one return flow reservoir 295 and/or at least one return flow pump 285 and/or at least one return flow valve 280, to at least one and preferably at least the same intermediate reservoir 257, in particular intermediate reservoir 257 for the at least one coating medium. The dimension of the interior of the at least one main reservoir 252 in axial direction A is at least as great as 50% of the width, measured in axial direction A, of the operating region of the nozzle bar 213 that contains the at least two print heads 212, and/or at least 50% of the working width of printing press 01, defined by the maximum printing material width that can be processed in printing press 01.

The at least one printing unit 200; 400 preferably has a plurality of main reservoirs 252, more preferably at least one main reservoir 252 for each printing ink to be printed, for example four main reservoirs 252. This is particularly preferably the case when print heads 212 which are assigned to different printing inks are aligned at different angles from vertical, as in that case, different liquid column heights result for relevant hydrostatic pressures. This is particularly preferably the case when print heads 212; 412 are arranged so as to be movable relative to one another, for example to different positions such as printing positions and/or idle positions, for example by means of corresponding positioning devices 217; 218; 219; 221. More preferably, therefore, two main reservoirs 252 are provided per double row of print heads 212; 412, thus particularly four main reservoirs 252 for each coating medium. Printing unit 200; 400 preferably has one return flow reservoir 295 for each nozzle bar 213 and/or for each positioning device 217; 218; 219; 221, with said return flow reservoir being connected at least indirectly to each of four main reservoirs 252.

The fill level of main reservoir 252, at least during a printing operation and more preferably perpetually, is preferably constant with only slight deviations within a narrow tolerance range. This constant fill level can be achieved, for example, by providing an influx of printing ink and an overflow drain 258. An overflow drain 258 is understood as a drain which establishes the maximum height of a fill level, particularly of the main reservoir 252. A controlled overflow drain 258 may be provided, which has at least one fill level sensor and at least one valve, for example. Preferably, however, at least one passive overflow drain 258 is provided. A passive overflow drain 258 is preferably an overflow drain 258 consisting substantially of an opening, the lower edge of which is arranged at a specific height, and which thereby establishes a maximum fill level. The at least one main reservoir 252 and/or the at least one drain line 256 preferably have at least one preferably passive overflow drain 258, the drain side of which is preferably arranged such that it is and/or can be connected directly or via interconnected components 263, 280; 285; 295 to the at least one intermediate reservoir 257, more preferably to the same at least one intermediate reservoir 257 to which the at least one main reservoir 252 is and/or can be connected via the at least one supply line 254. At least one filtering device 259 and/or at least one venting device 261 and/or at least one damping device 299 for damping pulsations is preferably arranged along the at least one supply line 254. At least one valve 262, preferably embodied as a first flow check valve 262, is preferably arranged within the at least one supply line 254, and/or at least one valve 263, preferably embodied as a second flow check valve 263, is preferably arranged within the at least one drain line 256.

At least one first liquid pump 264 is preferably arranged in the at least one supply line 254. Coating medium, in particular printing ink, is preferably pumped constantly into main reservoir 252, with excess coating medium being discharged through the at least one overflow drain 258, and with a level of the coating medium in main reservoir 252 being defined by the height at which an opening of overflow drain 258 is located. A controlled and/or regulated normal pressure preferably prevails in main reservoir 252, and is more preferably controlled and/or regulated relative to an ambient pressure, in particular atmospheric pressure. The constant level and the controlled and/or regulated normal pressure ensure that the pressure within the coating medium at the nozzle openings of print heads 212 is held constant. Constant operating conditions for print heads 212 are thereby ensured. In at least one first gas-filled space 266 of the at least one main reservoir 252, at least one gas volume is preferably provided, in which a normal pressure prevails which is lower than an ambient pressure present at an ejection side of at least one nozzle of the at least one print head 212. Thus the normal pressure in main reservoir 252 is preferably a negative pressure in relation to the ambient pressure. This negative pressure is preferably between 4 kPa (four kilopascal), or 40 mbar (forty millibar), and 6 kPa (six kilopascal), or 60 mbar (sixty millibar), more preferably between 4.5 kPa (four-and-a-half kilopascal), or 45 mbar (forty-five millibar), and 5.5 kPa (five-and-a-half kilopascal), or 55 mbar (fifty-five millibar). The installed position of print head 212 is preferably factored into any pressure adjustment, because the inclination of said print head will result in a different level and therefore in a different hydrostatic pressure, which can be compensated for by means of said pressure. The at least one main reservoir 252 preferably extends across at least 50%, more preferably at least 75%, and even more preferably at least 90% of the width of the operating region of the at least one nozzle bar 213 in axial direction A and/or the working width of printing press 01.

At least one return flow reservoir 295 is preferably arranged in the at least one drain line 256, more preferably at a lower height than the at least one main reservoir 252. At least one return flow pump 285, for example for pumping coating medium back into intermediate reservoir 257, which is preferably situated at a higher level, is preferably arranged along the at least one drain line 256, in particular downstream of the at least one return flow reservoir 295. The at least one intermediate reservoir 257 is preferably, but not necessarily, situated at a higher level than the at least one main reservoir 252. At least one reflux valve 280 is preferably arranged along the at least one drain line 256, upstream or preferably downstream of the at least one return flow pump 285. This ensures that a circular flow of coating medium is provided, within which coating medium can be conveyed by means of pumps and gravity.

Coating medium, for example printing ink, is preferably pumped by the at least one first liquid pump 264 from intermediate reservoir 257 into main reservoir 252. At least one and preferably precisely one volume provided as a first gas-filled space 266 is preferably arranged in the at least one main reservoir 252. The at least one first gas-filled space 266 is preferably arranged such that it is and/or can be connected via at least one first gas line 267 to at least one vacuum source 268; 276; 277. The at least one vacuum source 268; 276, 277 is embodied, for example, as at least one gas pump and/or at least one vacuum buffer 276 and/or at least one vacuum regulator 277. At least one liquid trap 293, in particular a coating medium trap 293, is preferably arranged in the at least one first gas line 267. The same normal pressure as in the at least one first gas-filled space 266 of the at least one main reservoir 252 is preferably present in a second gas-filled space 269 of intermediate reservoir 257. This is achieved, for example, by connecting the second gas-filled space 269 by means of at least one second gas line 271 to at least one second gas pump and/or to the at least one first gas-filled space 266 and/or to the at least one first gas pump 268 and/or to the at least one vacuum buffer 276 and/or more preferably to the at least one vacuum regulator 277. The at least one second gas line 271 preferably has at least one vacuum sensor 294.

At least one third gas-filled space 290 is preferably provided in the at least one return flow reservoir 295. The same normal pressure as in the at least one first gas-filled space 266 of the at least one main reservoir 252 is preferably present in the third gas-filled space 290 of return flow reservoir 295, at least as long as the at least one first valve 262 and the at least one second valve 263 are closed. This is achieved, for example, by connecting the third gas-filled space 290 by means of at least one equalizing line 286 to the at least one second gas pump and/or to the at least one first gas-filled space 266 and/or to the at least one first gas pump 268 and/or to the at least one vacuum buffer 276 and/or more preferably to the at least one vacuum regulator 277. The at least one equalizing line 286 preferably has at least one liquid trap 293, in particular a coating medium trap 293.

The at least one liquid trap 293, for example coating medium trap 293, is embodied, for example, as at least one hollow chamber having an inlet and an outlet. The inlet is preferably located at a distance above a lowest point in the hollow chamber. The outlet is preferably located at the level of the inlet or higher. The cross-section of the hollow chamber is preferably greater than the cross-section of a line connected to the inlet. Vacuum pressure is preferably applied to the outlet, thereby suctioning gas in via the inlet and through the hollow chamber. If liquid is suctioned in at the same time, it will preferably settle at the lowest point in the hollow chamber under the force of gravity, and will not be conveyed into the vacuum line connected to the outlet. A check can be made by means of a sensor and/or manually, for example visually, to determine whether liquid is present at the lowest point in the hollow chamber and needs to be removed. Removal can be carried out manually or automatically by means of an outlet, for example at the lowest point in the hollow chamber, which can be sealed and/or connected to a pump.

At least one vacuum pump 268 is preferably provided, to which the at least one vacuum buffer 276 is connected via at least one vacuum supply line 278. The at least one vacuum buffer 276 preferably is and/or can be connected via at least one venting line 279 to the at least one venting device 261. The at least one vacuum buffer 276 is preferably arranged such that it is and/or can be connected via at least one vacuum line 281 to at least one vacuum regulator 277, which preferably is and/or can be connected via at least one fresh air filter 292 to the surrounding environment. At least one normal pressure line 282 preferably connects the at least one vacuum regulator 277 to at least one pressure regulator 283. Vacuum regulator 277 preferably serves to adjust the pressure in the at least one normal pressure line 282 to normal pressure, in particular by admixing ambient air, for example at atmospheric pressure, into the air coming from vacuum buffer 276. The at least one pressure regulator 283 is preferably arranged connected to at least one compressed air source 284, for example at least one air pump 284, or to a connection to the surrounding environment 284. The at least one pressure regulator 283 is preferably arranged such that it is and/or can be connected via the at least one first gas line 267 to the at least one first gas-filled space 266 of the at least one main reservoir 252. In this manner, the normal pressure or an overpressure can optionally be generated in first gas line 267 and therefore in first gas-filled space 266 of main reservoir 252 by means of pressure regulator 283. Any resulting gas volumes that become enclosed as the system is being filled with coating medium can preferably be pumped out by means of respective equalizing lines 286, and/or can at least be acted on by the respective normal pressure. Such gas volumes can occur, for example, in an area of the at least one flow check valve 263 and/or particularly in the area of the at least one return flow reservoir 295.

Figure 8A:
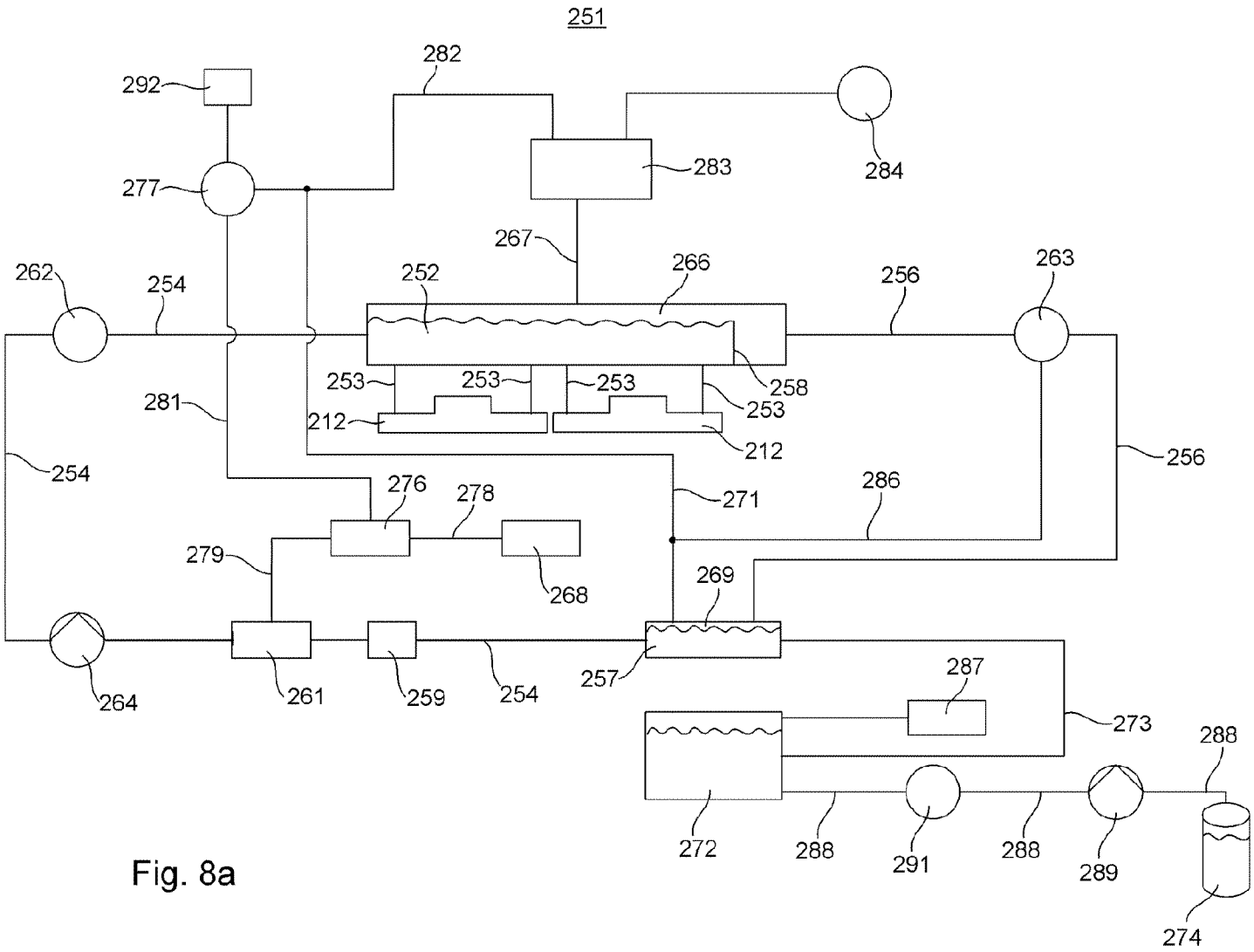
FIG. 8*a* a schematic diagram of a system for supplying coating medium.
Figure 8B:
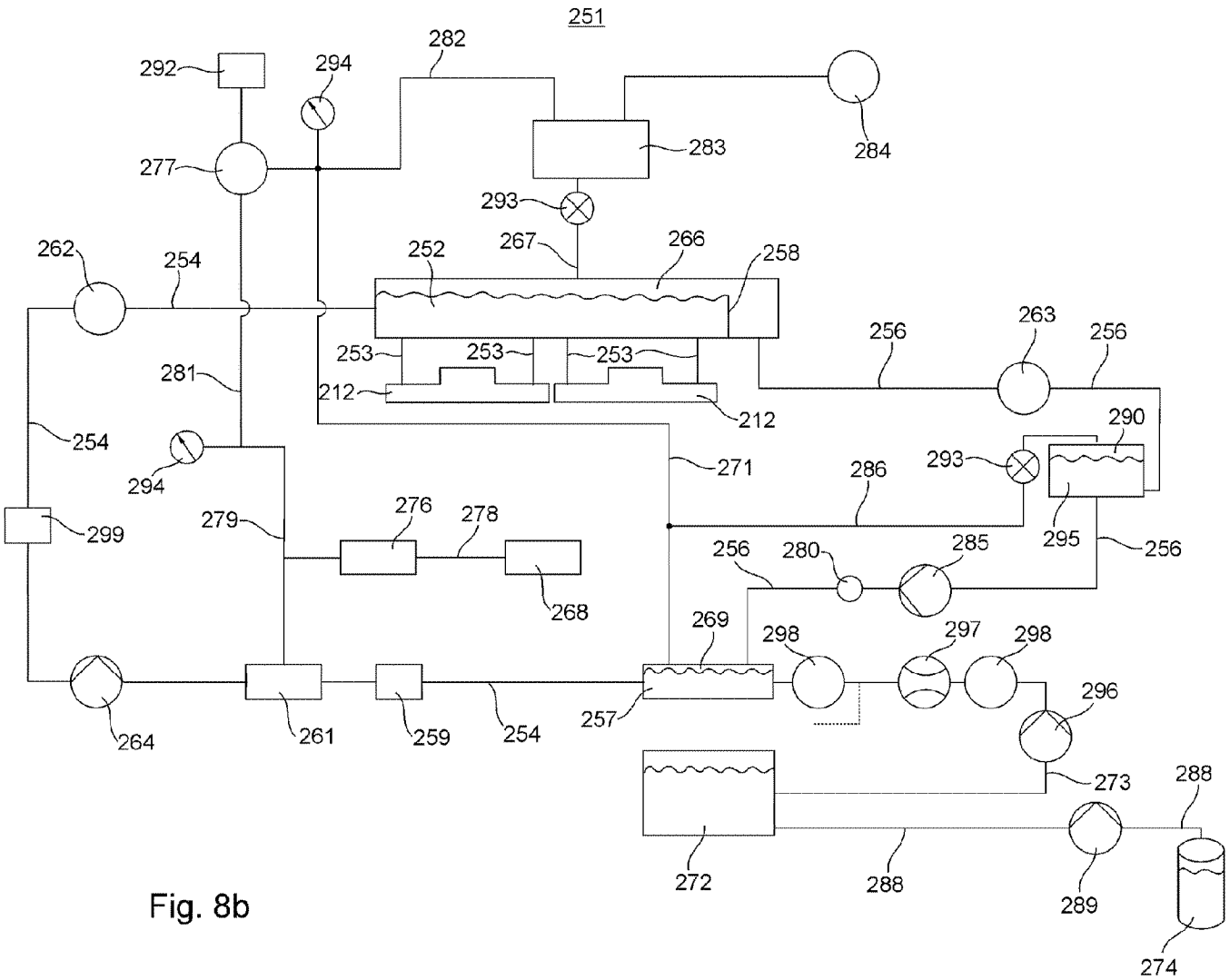
FIG. 8*b* a schematic diagram of an alternate system for supplying coating medium.
Figure 9A:
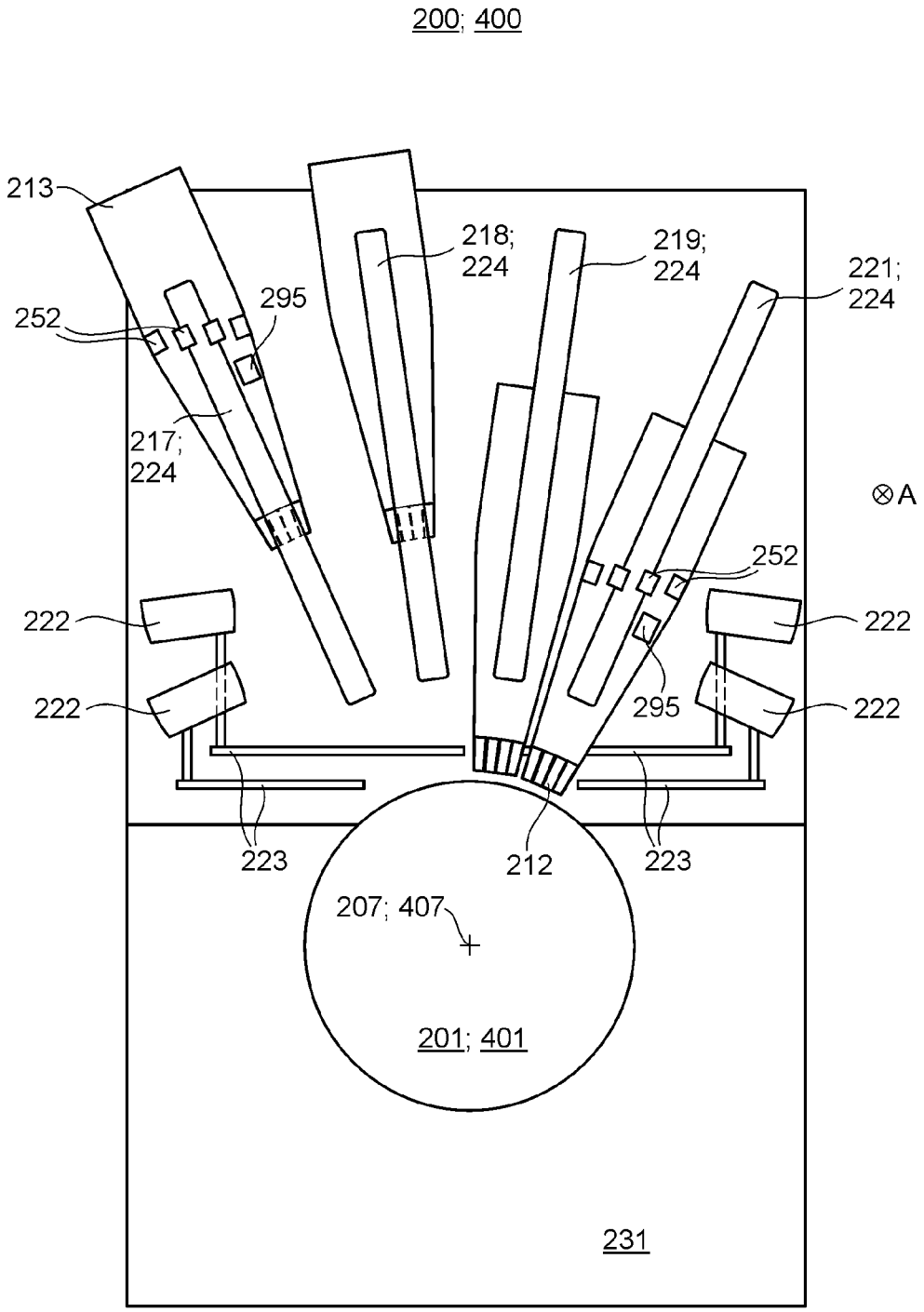
FIG. 9*a* a schematic diagram of a printing unit having four positioning devices and four maintenance devices, in which print heads are placed in printing positions by means of the two positioning devices on the right, and print heads are placed in idle positions, embodied as assembly positions, for example, by means of the two positioning devices on the left, the maintenance devices being located in parked positions, and in which only some main reservoirs and return flow reservoirs are shown, by way of example.
Figure 9B:
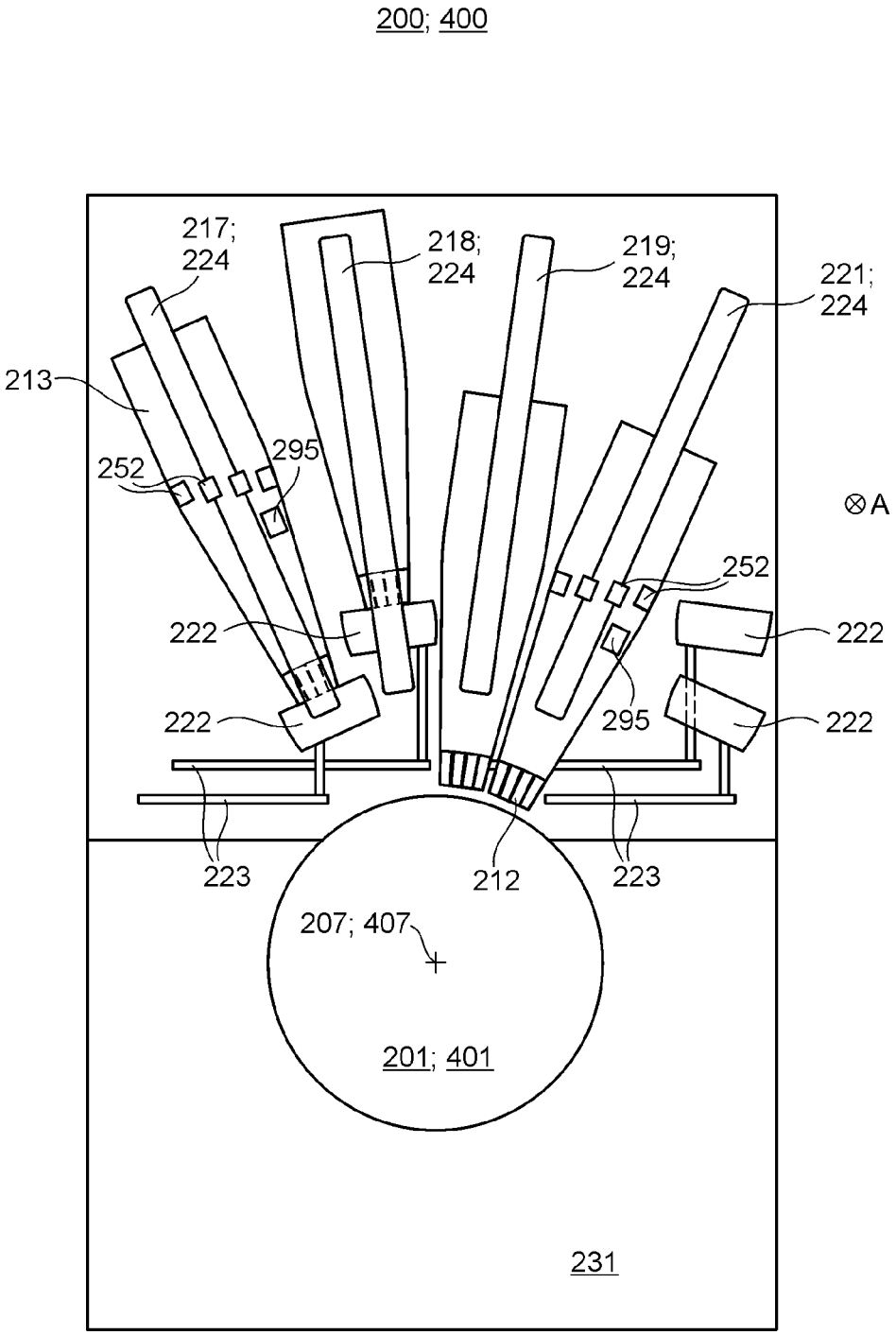
FIG. 9*b* a schematic diagram of a printing unit according to FIG. 9*a*, in which print heads are placed in printing positions by means of the two positioning devices on the right, and print heads are placed in maintenance positions by means of the two positioning devices on the left, and the two maintenance devices on the left are located in operating positions.

The at least one intermediate reservoir 257 is preferably connected to at least one buffer reservoir 272, more preferably via at least one supply line 273. In a first embodiment of supply line 273, by way of example, the at least one intermediate reservoir 257 is connected via at least one supply line 273 embodied as a suction line 273 to the at least one buffer reservoir 272. In that case, no liquid pump, or no pump at all, is provided along the at least one suction line 273 between the at least one buffer reservoir 272 and the at least one intermediate reservoir 257, for example, and/or buffer reservoir 272 is at ambient pressure and/or no pump is arranged between buffer reservoir 272 and intermediate reservoir 257, and instead, printing ink is conveyed out of buffer reservoir 272 into intermediate reservoir 257 by virtue of the relative negative pressure. This allows constant conditions to be ensured particularly in intermediate reservoir 257 and in main reservoir 252, in particular with respect to normal pressure. In a preferred second embodiment of supply line 273, by way of example, supply line 273 has at least one supply pump 296 and/or preferably at least one flow meter 297 and/or preferably at least one supply valve 298 and/or local supply valve 298. A supply line 273 can be subdivided downstream of a supply valve 298 into a plurality of partial lines, for example, which are connected to different printing units 200; 400 and which are embodied as sealable, independently of one another, by means of local supply valves 298. (In FIG. 8*b*, this option is indicated by a dashed line.)

Buffer reservoir 272 is and/or can be connected, for example, to a replaceable storage tank 274, which can also serve to supply other print heads 212 and/or other nozzle bars 213 and/or other printing units 200; 400 and/or other printing presses 01. The at least one buffer reservoir 272 preferably is and/or can be connected via at least one second supply line 273, for example suction line 273, to at least one additional intermediate reservoir 257, which is assigned to at least one additional, for example second printing unit 200; 400 of printing press 01. For example, at least one reserve supply pump 289 and at least one reserve supply valve 291 are arranged along at least one reserve supply line 288 between the at least one reserve storage tank 274 and the at least one buffer reservoir 272. The at least one buffer reservoir 272 has at least one overflow device 287, for example, via which excess coating medium can be discharged as needed, for example if the at least one reserve supply pump 289 and/or the at least one reserve supply valve 291 should malfunction. This serves to prevent any negative impact on the normal pressure. In one embodiment, by way of example, the at least one buffer reservoir 272 is eliminated, and instead, reserve storage tank 274 is provided directly at the location of buffer reservoir 272; in that case, reserve supply pump 289 is also eliminated, for example, and coating medium is fed in by means of reserve supply pump 296.

At least one and more preferably precisely one intermediate reservoir 257 is preferably provided for each printing unit 200; 400 and each coating medium. At least one main reservoir 252 and more preferably precisely four main reservoirs 252 are preferably provided for each printing unit and each coating medium. At least one and more preferably precisely one return flow reservoir 295 is preferably provided for each printing unit and each coating medium. For example, in the case of a four-color press that has two printing units 200; 400, eight intermediate reservoirs 257 and thirty-two main reservoirs 252 and eight return flow reservoirs 295 are provided. Precisely one vacuum source 268 is preferably provided for each printing unit 200; 400 and more preferably for each printing press 01. Precisely one reserve storage tank 274 and/or precisely one buffer reservoir 272 is preferably provided for each coating medium, in particular for printing ink for the entire printing press 01.

The at least one intermediate reservoir 257 is preferably stationary relative to a frame 231 of the respective printing unit 200; 400. The at least one main reservoir 252, together with the at least one print head 212; 412 and/or the at least one nozzle bar 213; 413, is preferably arranged so as to be movable by means of a corresponding positioning device 217; 218; 219; 221, and/or the at least one return flow reservoir 295, together with the at least one print head 212; 412 and/or the at least one main reservoir 252 and/or the at least one nozzle bar 213; 413, is preferably arranged so as to be movable by means of a corresponding positioning device 217; 218; 219; 221. As a result, constant hydrostatic pressure conditions are particularly ensured, for example within the at least one main reservoir 257 and/or within the at least one print head 212; 412.

Printing press 01 preferably permits a process for cleaning at least one nozzle of each of at least two print heads 212, embodied as inkjet print heads 212, of printing press 01, wherein printing press 01 comprises the at least one supply system 251, which comprises the at least one main reservoir 252, preferably for the at least one coating medium, and the at least one intermediate reservoir 257, preferably for the at least one coating medium, and wherein each of the at least two print heads 212; 412 is arranged such that it is and/or can be connected via at least a first fluid line 253 preferably directly to the at least one main reservoir 252, and wherein the at least one main reservoir 252 is connected via the at least one supply line 254 and the at least one drain line 256 to preferably the same at least one intermediate reservoir 257, and wherein first, each of the at least one supply lines 254 is preferably closed by means of the at least one first flow check valve 262 and each of the at least one drain lines 256 is preferably closed by means of the at least one second flow check valve 263, and wherein subsequently, a pressure within the gas volume located within the at least one main reservoir 252 is preferably increased by means of at least the at least one first gas pump 268 and/or by means of at least the at least one compressed air source 284, and as a result, coating medium and particularly printing ink is conveyed through the at least one nozzle of the at least two print heads 212 and preferably ejected.

A plurality of print heads 212, for example a plurality of print heads 212 of a common nozzle bar 213, in particular a plurality of print heads 212 or more preferably all the print heads of a double row of print heads 212, preferably have a common voltage supply system. At least one common power supply line for the voltage supply preferably extends within the respective at least one nozzle bar over at least 50%, more preferably at least 75% and even more preferably at least 90% of the width of the operating region of the respective at least one nozzle bar 213 in axial direction A and/or of the working width of printing press 01. Each print head 212 of said respective at least one nozzle bar 213 preferably has at least one dedicated power line, which is connected to said common power supply line for the voltage supply. Each print head 212 of said respective at least one nozzle bar 213 preferably has at least one dedicated data line, which is connected to a computer unit which is arranged outside the operating region of the respective at least one nozzle bar 213 with respect to axial direction A, and/or outside of each transport path provided for printing material 02 in printing press 01 with respect to axial direction A. Thus at least one data line per print head 212 of said at least one nozzle bar 213 extend parallel to one another, at least along a section of nozzle bar 213 that extends in axial direction A.

Printing press 01 preferably has at least one printing unit 200; 400, wherein the at least one printing unit 200; 400 has at least one print head 212; 412, preferably embodied as an inkjet print head 212; 412 and having an ejecting direction, and preferably has a plurality of print heads 212; 412, preferably each being embodied as an inkjet print head 212; 412 and having an ejecting direction, and also preferably has at least one printing material guiding element 201; 401 which is rotatable around a respective rotational axis 207; 407, by means of which preferably at least one transport path provided for preferably a web-type printing material 02 is and/or can be at least partially defined. The at least one nozzle, and more preferably each nozzle, preferably has an ejecting direction which is clearly defined relative to the nozzle and relative to the print head 212 that contains the nozzle. Ejecting directions of nozzles of a common print head 212 are preferably aligned parallel to one another. The ejecting direction of at least one nozzle of the at least one print head 212 is preferably aligned toward a circumferential surface of the at least one printing material guiding element 201; 401, at least when print head 212 is in a printing position.

The at least one printing material guiding element 201; 401 is preferably arranged within the at least one printing unit 200; 400, and/or the at least one printing material guiding element 201; 401 is preferably embodied as at least one web guiding roller and/or one turning roller 203; 214; 312; 403; 414 and/or as at least one central printing cylinder 201; 401 and/or as at least one transfer element.

The at least one print head 212; 412 preferably is and/or can be connected to at least one positioning device 217; 218; 219; 221. More preferably, the at least one print head 212 is permanently connected to the at least one positioning device 217; 218; 219; 221 and can be removed from the at least one positioning device 217; 218; 219; 221 only for purposes of assembly and/or disassembly and/or for replacing the at least one print head 212. The at least one printing unit 200; 400 preferably has at least two and more preferably at least four nozzle bars 213; 413, each of which has at least two print heads 212; 412. Each nozzle bar 213; 413 preferably is and/or can be connected to at least one positioning device 217; 218; 219; 221, and in this way, each corresponding print head 212; 412 is and/or can be connected simultaneously to at least one positioning device 217; 218; 219; 221. The at least two, particularly at least four nozzle bars 213; 413 are preferably arranged so as to be movable by means of a respective positioning device 217; 218; 219; 221 along a respective, for example linear actuating path. Preferably, at least one of at least two print heads 212 can selectively be placed at least either in a printing position assigned to said print head or in at least one idle position assigned to said print head, further preferably by means of a positioning device 217 assigned to said print head. Further preferably, each of at least four print heads 212; 412 can selectively be placed at least either in a printing position assigned to said print head or in at least one idle position assigned to said print head, further preferably by means of a positioning device 217; 218 assigned to said print head.

The at least one print head 212 can preferably be placed in at least one printing position, in particular by means of at least one positioning device 217; 218; 219; 221. A print head 212 arranged in its printing position is preferably characterized in that at least one nozzle of the at least one print head 212 is spaced from a provided transport path for printing material 02 and/or from printing material 02 and/or from a transfer element and/or from printing material guiding element 201; 401 by a distance of at most 5 mm and more preferably at most 1.5 mm and/or by a distance of at least 0.5 mm and more preferably at least 1 mm. A print head 212 arranged in its printing position is preferably characterized in that the ejecting direction of each of a majority of all the nozzles of the at least one print head 212 deviates a maximum of 10° and more preferably a maximum of 6° and even more preferably a maximum of 3° from a surface normal of a surface element of the provided transport path for printing material 02 that is closest to the respective nozzle, and/or from a surface normal of a surface element of the printing material 02 that is closest to the respective nozzle and/or from a surface normal of a surface element of a transfer element that is closest to the respective nozzle and/or from a surface normal of a surface element of a printing material guiding element 201; 401 that is closest to the respective nozzle.

A print head 212 arranged in its printing position is preferably characterized in that the ejecting direction of each of a majority of all the nozzles of the at least one print head 212 deviates from a vertical direction by a maximum of 30°. At least when print head 212 is arranged in the printing position, an ejecting direction of at least one and preferably of each nozzle of at least said print head 212 is preferably aligned toward at least one printing material guiding element 201; 401 and/or at least one transfer element. At least when print head 212 is arranged in the printing position, at least one nozzle of said print head 212 is preferably arranged in a position designated for a printing operation of said at least one nozzle.

The at least one print head 212 can preferably be placed in at least one idle position and more preferably in at least two different idle positions, in particular by means of the at least one positioning device 217; 218; 219; 221. The at least one idle position is embodied, for example, as at least one maintenance position and/or as at least one assembly position. A maintenance position in this context is preferably a position in which maintenance can be performed on the at least one print head 212, for example it can be cleaned and/or aligned and/or held in a state in which it is protected particularly against soiling and/or drying out, in particular without removing the at least one print head 212 from printing press 01 and/or from the at least one printing unit 200; 400. An assembly position in this case is preferably a position in which the at least one print head 212 can be removed from printing press 01 and/or from the at least one printing unit 200; 400 and/or from the at least one nozzle bar 213, and/or can be installed in printing press 01 and/or in the at least one printing unit 200; 400 and/or in the at least one nozzle bar 213. In particular, the assembly position preferably provides additional space to an operator for accessing the at least one print head 212, whereas the maintenance position preferably provides only enough space to allow internal, particularly automatically running processes to be performed within printing press 01.

Respective idle positions of the print heads 212, regardless of whether said positions are embodied as maintenance positions and/or as assembly positions, are preferably characterized in that different print heads 212 in their respective idle positions are spaced at least partially different distances from the provided transport path for printing material 02 and/or from a printing material 02 and/or from a transfer element and/or from the printing material guiding element 201; 401, in particular central cylinder 201; 401. Each nozzle of the at least one print head 212; 412 arranged in its maintenance position is preferably spaced a distance of at least 10 cm and more preferably at least 25 cm from a surface element of the provided transport path for printing material 02 that is closest to the respective nozzle, and/or from a surface element of printing material 02 that is closest to the respective nozzle, and/or from a surface element of a transfer element that is closest to the respective nozzle and/or from a printing material guiding element 201; 401, in particular a central cylinder 201; 401.

Respective maintenance positions of print heads 212 are preferably characterized in that the spacing between different print heads 212 arranged in their respective maintenance positions is different from the spacing between said print heads in their respective printing positions and/or in their respective assembly positions.

Respective assembly positions of print heads 212 are preferably characterized in that the spacing between different print heads 212 arranged in their respective assembly positions is different from the spacing between said print heads in their respective printing positions and/or in their respective maintenance positions. Each nozzle of the at least one print head 212; 412 arranged in its assembly position is preferably spaced a distance of at least 20 cm and more preferably at least 35 cm from a surface element of the provided transport path for printing material 02 that is closest to the respective nozzle, and/or from a surface element of printing material 02 that is closest to the respective nozzle, and/or from a surface element of a transfer element that is closest to the respective nozzle and/or from a printing material guiding element 201; 401, in particular a central cylinder 201; 401. Said distances are preferably measured in the axial projection plane.

In a first possible embodiment, the at least one positioning device 217; 218, 219; 221 has at least one positioning guide 224 embodied as a lever arm 224, for example a plurality of positioning guides 224, particularly four, preferably embodied as lever arms 224, and for example in each case one positioning guide 224, preferably embodied as a lever arm 224, per movable nozzle bar 213 and/or per movable print head 212. For example, and particularly if the at least one positioning guide 224 is embodied as at least one lever arm 224, the actuating path of the at least one print head 212; 412 is embodied as at least one arc. A pivot axis 227 of the at least one lever arm 224 is arranged parallel to axial direction A, for example. This serves to ensure that movements of the at least one lever arm 224 and of the at least one print head 212 and/or nozzle bar 213 arranged thereon, for example, will occur only within a plane defined by a surface normal which is arranged parallel to axial direction A, in particular within the axial projection plane. At least two positioning devices 217; 218 have different pivot axes 227 from one another, for example. Additionally or alternatively, at least two positioning devices have a common pivot axis 227, for example.

With respect to the first possible embodiment of the at least one positioning device 217; 218, 219; 221, respective maintenance positions of the print heads 212 are characterized, for example, in that when print head 212 is arranged in its respective maintenance position, the ejecting directions of all the nozzles of said print head 212 point in a vertical direction, in particular a vertically downward pointing direction, to within a maximum tolerance range of 20° and more preferably 12° and even more preferably 8°. In particular, a direction which is defined as the arithmetic mean of all the ejecting directions of all the nozzles of the nozzle bar 213 containing the at least one print head 212; 412 arranged in its maintenance position preferably deviates from the vertical direction by a maximum of 12°, more preferably a maximum of 8° and even more preferably a maximum of 4°.

With respect to the first possible embodiment of the at least one positioning device 217; 218, 219; 221, respective maintenance positions of the print heads 212 are characterized, for example, in that the ejecting directions of each of the nozzles of different print heads 212 arranged in their respective maintenance positions are oriented at different angles in relation to the next closest surface element of the provided transport path for printing material 02 and/or of the web guiding element 201; 401 and/or of the transfer element and/or of printing material 02, with said difference between the angles more preferably amounting to at least 2°, preferably at least 6°, and more preferably at least 10°. A plane in which this angle is measured is preferably defined by a surface normal which extends parallel to axial direction A or deviates from said axial direction A by a maximum of 2°. This plane is preferably referred to as the axial projection plane.

With respect to the first possible embodiment of the at least one positioning device 217; 218, 219; 221, respective assembly positions of print heads 212 are characterized, for example, in that the ejecting directions of each of the nozzles of different print heads 212 arranged in their respective assembly positions are oriented at different angles in relation to the next closest surface element of the provided transport path for printing material 02 and/or of web guiding element 201; 401 and/or of the transfer element and/or of printing material 02, said difference between the angles more preferably amounting to at least 2°, preferably at least 6° and more preferably at least 10°. A plane in which this angle is measured is preferably defined by a surface normal which extends parallel to axial direction A or deviates from said axial direction A by a maximum of 2°. Said plane is more preferably the axial projection plane.

With respect to the first possible embodiment of the at least one positioning device 217; 218, 219; 221, respective assembly positions of print heads 212 are characterized, for example, in that, when print head 212 is arranged in its respective assembly position, the ejecting directions of each of the nozzles of said print head 212 differ by preferably at least 4° and more preferably at least 6° and even more preferably at least 8° from a vertical direction, in particular a downward pointing vertical direction. In particular, a direction which is defined as the arithmetic mean of all the ejecting directions of all the nozzles of the nozzle bar 213 that contains the at least one print head 212; 412 arranged in its assembly position deviates from a vertical direction by at least 4°, more preferably at least 6° and even more preferably at least 8°.

With respect to the first possible embodiment of the at least one positioning device 217; 218, 219; 221, respective assembly positions of print heads 212 are characterized, for example, in that, when print head 212 is arranged in its respective assembly position, a direction that is defined as the arithmetic mean of all the ejecting directions of all the nozzles of the nozzle bar 213 that contains the at least one print head 212; 412 arranged in its assembly position deviates at least 20° and more preferably at least 30° from a surface normal of a surface element of the provided transport path for printing material 02 that is closest to the respective nozzle and/or from a surface normal of a surface element of printing material 02 that is closest to the respective nozzle and/or from a surface normal of a surface element of a transfer element that is closest to the respective nozzle and/or from a printing material guiding element 201; 401.

With respect to the first possible embodiment of the at least one positioning device 217; 218, 219; 221, at least one assembly position of at least one print head 212 and preferably of all print heads 212 is characterized, for example, in that, in the axial projection plane and/or in a plane that is defined by a surface normal that extends parallel to axial direction A or that deviates from said axial direction A by a maximum of 2°, the ejecting directions of all the nozzles of print head 212 arranged in its printing position have a horizontal component which is precisely opposite a horizontal component of the ejecting directions of all the nozzles of said print head 212 in its assembly position. As a result, in particular, respective print heads 212 can preferably be transferred by at least one pivoting movement from their printing position through their maintenance position to their assembly position.

In a second and preferred embodiment of the at least one positioning device 217; 218, 219; 221, the at least one positioning device 217; 218, 219; 221 has at least one linear positioning guide 224, preferably embodied as a track 224, and more preferably has a plurality of positioning guides 224, in particular four, preferably embodied as tracks 224, and even more preferably has at least one positioning guide 224, preferably embodied as a track 224, for each movable nozzle bar 213 and/or for each movable print head 212. More preferably, two positioning guides 224, embodied as tracks 224, are provided for each nozzle bar 213, in particular one track 224 for each axial end of the at least one printing material guiding element 201; 401, or a total of at least eight tracks 224 per printing unit 200; 400. Preferably, and particularly if the at least one positioning guide 224 is embodied as at least one track 224, the actuating path of the at least one print head 212; 412 is embodied as linear.

Preferred therefore is a printing press 01 which has at least one printing unit 200; 400 having at least two, more preferably at least three and even more preferably at least four print heads 412, 212 and at least one printing material guiding element 201; 401 that is rotatable around a rotational axis 207; 407, wherein each of the at least two, preferably at least three and more preferably at least four print heads 212; 412 is arranged so as to be movable along a respective linear actuating path by means of a respective positioning device 217; 218; 219; 221 assigned to at least said print head 212; 412. More preferably, the linear actuating paths have respective actuating directions that differ in pairs by at least 10° and more preferably by at least 15°, and regardless of the lower limit, differ by at most 150°, more preferably by at most 120°, even more preferably by at most 90° and more preferably still by at most 60°. All the actuating directions of positioning devices 217; 218; 219; 221 of the same printing unit 200; 400 in all possible pairwise arrangements preferably differ by at least 10° and more preferably by at least 15°, and regardless of the lower limit, differ by at most 150°, more preferably by at most 120°, even more preferably by at most 90° and more preferably still by at most 60°. Actuating directions of print heads 212; 412 to which adjacent positioning devices 217; 218, 219; 221 are assigned preferably differ from one another by at least 10° and more preferably by at least 15°, and regardless of the lower limit, differ by at most 60°, more preferably by at most 45°, even more preferably by at most 30° and more preferably still by at most 20°. Preferably, it is ensured that movements of the at least one print head 212 and/or nozzle bar 213 occur only within a plane that is defined by a surface normal which is parallel to axial direction A, in particular within the axial projection plane.

Each of the at least two, preferably at least three and more preferably at least four print heads 212; 412 preferably can selectively be placed, by means of the respective positioning device 217; 218; 219; 221, at least either in a printing position assigned to said print head and in at least one maintenance position assigned to said print head, wherein when a first print head 212; 412 of the at least two, preferably at least three and more preferably at least four print heads 212; 412 is in the at least one maintenance position, at least one maintenance device 222 is and/or can be assigned to at least one first nozzle of the at least one first print head 212; 412. The description above and in the following in reference to the at least one maintenance device 222 preferably applies to each maintenance device 222, particularly also when two, three or four maintenance devices are provided per printing unit 200; 400. The at least one maintenance device 222 is preferably arranged so as to be movable along at least one staging path between at least one parked position and at least one operating position, in particular by means of at least one transport device 223. If a plurality of maintenance devices 222 is provided, a separate staging path, a separate parked position and a separate operating position are preferably assigned to each maintenance device 222. An optionally provided component of the respective staging path of the at least one maintenance device 222 in an axial direction A defined by rotational axis 207; 407 of the at least one rotatable printing material guiding element 201; 401 preferably amounts to a maximum of 50% of the width, measured in axial direction A, of an operating region of a nozzle bar 213 containing the at least one print head 212, and/or a maximum of 50% of a working width of printing press 01, defined by a maximum printing material width that can be processed in printing press 01.

The actuating directions of the linear actuating paths are preferably each aligned orthogonally and particularly radially in relation to rotational axis 207; 407 of the at least one rotatable printing material guiding element 201; 401. All the print heads 212; 412 in their printing positions and their idle positions, in particular maintenance positions and/or assembly positions, are preferably arranged such that their respective nozzles are always in the respectively same alignment in terms of their ejecting direction. Print heads 212; 412 preferably have linear actuating paths.

The at least one positioning device 217; 218, 219; 221 preferably has at least one positioning drive 226 and more preferably a plurality of positioning drives 226 and even more preferably one positioning drive 226 per movable nozzle bar 213. For example, one positioning drive 226 is assigned to each positioning guide 224. The at least one positioning drive 226 is embodied, for example, as at least one hydraulic cylinder 226 and/or as at least one pneumatic cylinder 226 and/or preferably as at least one electric motor 226. The at least one positioning drive 226 is preferably arranged such that it can move the at least one print head 212 either to its printing position, or to its maintenance position or to its assembly position, and can more preferably hold it there. The at least one positioning drive 226 is preferably embodied as at least one electric motor 226, for example as at least one stepped motor 226, and/or is connected to at least one threaded spindle. The at least one threaded spindle is preferably engaged with at least one spindle nut, which is connected to the respective nozzle bar 213.

At least four positioning devices 217; 218; 219; 221 are preferably provided, by means of each of which at least one nozzle bar 213 and/or particularly a plurality of print heads 212 assigned to the same printing ink can be moved together. This enables particularly configurations in which the print heads 212 of at least one nozzle bar 213 and/or at least one printing ink are arranged in their printing position while the print heads 212 of at least one other nozzle bar 213 and/or one other printing ink are arranged in an idle position, for example a maintenance position. In this manner, for example, all the print heads 212 of one printing ink, for example black, can be activated, while all the print heads 212 of other printing inks are held in a maintenance position, where they are protected against drying out and/or are cleaned, for example by suitable means.

At least one first locking element is preferably provided, for example, at least one printing stop. The at least one first locking element can preferably secure the at least one print head 212 in its printing position, for example by the at least one positioning drive 226, in particular pneumatic cylinder 226 and/or electric motor 226, pulling and/or pushing the at least one print head 212 and/or the nozzle bar 213 that contains the at least one print head 212 against the at least one printing stop. This serves to ensure that the printing position is reproducibly and precisely defined.

At least one second locking element is preferably provided, for example at least one assembly stop. The at least one second locking element can preferably secure the at least one print head 212 in its assembly position, for example by the at least one positioning drive 226, in particular pneumatic cylinder 226 and/or electric motor 226, pulling and/or pushing the at least one print head 212 and/or the nozzle bar 213 that contains the at least one print head 212 against the at least one assembly stop. This serves to ensure that the assembly position is reproducibly and precisely defined.

At least one third locking element is preferably provided, for example at least one maintenance stop. The at least one third locking element can preferably secure the at least one print head 212 in its maintenance position, for example by the at least one positioning drive 226, in particular pneumatic cylinder 226 and/or electric motor 226, pulling and/or pushing the at least one print head 212 and/or the nozzle bar 213 that contains the at least one print head 212 against the at least one maintenance stop. This serves to ensure that the maintenance position is reproducibly and precisely defined.

At least one locking element, preferably the at least one third locking element and/or at least one locking element arranged between two locking elements and/or at least one maintenance stop is preferably embodied as movable, to enable movement between extreme positions of an actuating path of the at least one print head 212 and/or of the at least one nozzle bar 213, in particular between printing position and assembly position. For example, at least one maintenance device 222 is embodied as at least one movable stop, in particular as a maintenance stop.

In the at least one maintenance position, at least one maintenance device 222 preferably is and/or can be assigned to at least one nozzle of the at least one print head 212; 412, and more preferably, the at least one maintenance device 222 is and/or can be arranged at least partially opposite at least one nozzle of the at least one print head 212; 412 in terms of a respective ejecting direction of said at least one nozzle.

A location of said respective at least one nozzle when print head 212 is arranged in the at least one printing position and a location of said respective at least one nozzle when print head 212 is arranged in the at least one maintenance position and/or assembly position, with respect to axial direction A, which is defined by the rotational axis 207; 407 of the at least one printing material guiding element 201; 401, preferably embodied as central cylinder 201, preferably differ by a maximum of 50%, more preferably a maximum of 20%, even more preferably a maximum of 10% and more preferably still a maximum of 2% of a width, measured in axial direction A, of an operating region of a nozzle bar 213 that contains the at least one print head 212; 412, and/or by a maximum of 50%, more preferably a maximum of 20%, even more preferably a maximum of 10% and more preferably still a maximum of 2% of the working width of printing press 01, defined by a maximum printing material width that can be processed in said printing press 01.

When print head 212 is arranged in the at least one maintenance position, at least one maintenance device 222 preferably can be and/or is arranged between at least one nozzle of the at least one print head 212; 412 and a region of the transport path, provided for printing material 02, that is closest to said at least one nozzle, and/or, when print head 212 is arranged in the at least one maintenance position, at least one maintenance device 222 can be and/or is arranged between at least one nozzle of the at least one print head 212 and a region of a transfer element that is closest to said at least one nozzle.

The dimensions of the at least one maintenance device 222 in each spatial direction are preferably greater than 3 mm, more preferably greater than 10 mm. The dimension of the at least one maintenance device 222 in axial direction A is preferably at least as great as the operating region of the at least one nozzle bar 213 in axial direction A. The dimension of the at least one maintenance device 222 in a transport direction of printing material 02 is preferably at least as great as the operating region of the at least one nozzle bar 213 in the transport direction of printing material 02. In this manner, all the nozzles of all the print heads 212 of the at least one nozzle bar 213 can preferably be maintained simultaneously. Marginal areas and/or the housing will result in even greater dimensions in some directions.

The at least one nozzle bar 213 can preferably be moved fully independently of components of printing press 01 that are arranged touching printing material web 02 and/or tangential to the provided transport path of printing material 02. Thus cleaning and/or maintenance can be performed without affecting the printing material web 02 and particularly without having to remove printing material web 02 from printing press 01.

The at least one maintenance device 222 is preferably movable at least orthogonally to axial direction A. A staging path of the at least one maintenance device 222 is preferably defined by at least one transport device 223. The at least one transport device 223 is preferably embodied as at least one guiding system 223. The at least one maintenance device 222 is preferably arranged so as to be movable along the at least one staging path between at least one parked position and at least one operating position. The staging path of the at least one maintenance device 222, which path is further preferably defined by the at least one transport device 223, preferably has no component in axial direction A that is greater than a maximum of 50%, more preferably a maximum of 20%, even more preferably a maximum of 10% and more preferably still a maximum of 2% of the width of the operating region, measured in axial direction A, of the nozzle bar 213 that contains the at least one print head 212, and/or a maximum of 50%, more preferably a maximum of 20%, even more preferably a maximum of 10% and more preferably still a maximum of 2% of the working width of printing press 01, defined by the maximum printing material width that can be processed in printing press 01. This means that an optionally existing component of the staging path of the at least one maintenance device 222 in axial direction A is preferably a maximum of 50%, more preferably a maximum of 20%, even more preferably a maximum of 10% and more preferably still a maximum of 2% of the width, measured in axial direction A, of the operating region of the nozzle bar 213 that contains the at least one print head 212, and/or a maximum of 50%, more preferably a maximum of 20%, even more preferably a maximum of 10% and more preferably still a maximum of 2% of the working width of printing press 01, defined by the maximum printing material width that can be processed in printing press 01.

Thus an optionally provided portion of an axial movement of the at least one maintenance device 222, assuming such movement is present, preferably amounts to a maximum of 50%, more preferably a maximum of 20%, even more preferably a maximum of 10% and more preferably still a maximum of 2% of the width, measured in axial direction A, of the operating region of the nozzle bar 213 that contains the at least one print head 212; 412, and/or a maximum of 50%, more preferably a maximum of 20%, even more preferably a maximum of 10% and more preferably still a maximum of 2% of the working width of printing press 01, defined by the maximum printing material width that can be processed in printing press 01. Further preferably, the at least one maintenance device 222 is movable exclusively orthogonally to axial direction A. The portion of a movement is particularly a length of a path traveled during said movement, and in this case is particularly only the length of a component of the path that is or will be traveled in axial direction A, assuming such a component is present.

A location of the at least one maintenance device 222 in its parked position, provided in relation to axial direction A, preferably differs from a location of the at least one maintenance device 222 in its operating position, provided in relation to axial direction A, by a maximum of 50%, more preferably a maximum of 20%, even more preferably a maximum of 10% and more preferably still a maximum of 2% of a width, measured in axial direction A, of an operating region of a nozzle bar 213 that contains the at least one print head 212, and/or by a maximum of 50%, more preferably a maximum of 20%, even more preferably a maximum of 10% and more preferably still a maximum of 2% of a working width of printing press 01, defined by a maximum printing material width that can be processed in printing press 01.

Each maintenance device 222 preferably has at least one dedicated transport device 223. The at least one transport device 223 preferably has at least one transport drive 229 and at least one pulling means 228 and/or pushing means 228. In one embodiment, the at least one transport drive 229 is arranged stationary on a frame 231 of the at least one printing unit 200; 400, and the at least one pulling means 228 and/or pushing means 228 is connected to the at least one maintenance device 222 and is embodied as movable relative to the frame 231 of the at least one printing unit 200; 400, for example as a chain 228. In an alternative embodiment, the at least one transport drive 229 is arranged so as to be movable, particularly together with the at least one maintenance device 222, and the at least one pulling means 228 and/or pushing means 228 is arranged as stationary, and is embodied, for example, as at least one track 228 and/or toothed rack 228. The at least one transport device 223 preferably has at least one rotatable threaded spindle, which is engaged with at least one spindle nut mounted on the respective maintenance device 222 and is arranged so as to rotate, for example by means of at least one transport drive 229 preferably embodied as a stepped motor 229.

At least two maintenance devices 222, which are and/or can be assigned, particularly by means of their respective transport devices 223, to different print heads 212; 412 of the at least two, in particular at least four print heads, are preferably arranged with one at least partially above the other, at least in their respective parked positions. More preferably, these at least two maintenance devices 222, which are and/or can be assigned, particularly by means of their respective transport devices 223, to different print heads 212; 412 of the at least two, in particular at least four print heads, are arranged offset and/or spaced from one another in a direction orthogonal to axial direction A, at least in their operating positions. In a preferred embodiment, four nozzle bars 213; 413 are provided, each of which is arranged so as to be movable out of its printing position in a respective linear actuating direction by means of a respective positioning device 217; 218; 219; 221. More preferably, four maintenance devices 222 embodied as cleaning devices 222 are provided and can be moved individually between parked position and operating position by means of respective transport devices 223. Each of the respective transport devices 223 preferably has two tracks 228 arranged on opposite sides of the frame 231. Each of the respective transport devices 223 preferably has at least one transport drive 229 or two transport drives 229 arranged on opposite sides of the frame 231. The maintenance devices 222 are preferably arranged symmetrically around a plane of symmetry that contains the entire rotational axis 207; 407 of the at least one printing material guiding element 201; 401. The four staging paths preferably extend horizontally and at a total of two different heights. The maintenance devices 222 are arranged at a higher level than the tracks 228 assigned to them, for example.

The respective assembly positions of two and more preferably of all nozzle bars 213; 413 are preferably arranged at the same height and therefore at different distances from the corresponding printing positions. The respective maintenance positions of two nozzle bars 213; 413 are preferably arranged at a first common height, which differs from a second common height at which the respective maintenance positions of the other two nozzle bars 213; 413 are arranged. These heights differ by at least five centimeters, for example. Sufficient space is thereby provided for all the maintenance devices 222 in their respective operating positions because the heights of these operating positions are different and therefore the volumes required by the different maintenance devices 222 do not collide.

A unique maintenance position is preferably assigned to the at least one print head 212 and more preferably to each print head 212. When the at least one maintenance device 222 is located in its operating position, it serves, for example, as the third locking element, for example in the form of at least one maintenance stop. When a print head 212 is located in its maintenance position, the nozzle bar 213 that contains the corresponding print head 212 is preferably pulled and/or pushed against the maintenance device by a force exerted by means of the at least one positioning drive 226 and/or by the force of gravity, in particular when positioning drive 226 is switched off. The maintenance position is thereby clearly defined. Alternatively and preferably, each positioning drive 226 has at least one stepped motor, by means of which the respective maintenance device 222 can be moved into unique positions. As a result, a positioning drive 226 and a transport drive 229 are sufficient for reproducibly and precisely positioning the print heads 212 in their printing positions, maintenance positions and assembly positions.

A unique operating position of at least one and preferably of precisely one maintenance device 222 is preferably assigned to each maintenance position of at least one print head 212. For example, the at least one maintenance device 222 is embodied as at least one protective cover 222, which can more preferably be used to delimit an isolated volume together with the at least one print head 212; 412. The at least one maintenance device 222 is preferably additionally or alternatively embodied as at least one cleaning device 222. The at least one maintenance device 222 is preferably embodied as at least one inspection device 222.

In a first embodiment, by way of example, at least two or at least three operating positions and/or at least one parked position in which the respective maintenance device 222, and more preferably optionally different maintenance devices 222 are and/or can be arranged can be assigned to the at least one maintenance device 222. For a total of four nozzle bars 213 of a printing unit 200; 400, for example, a total of two maintenance devices 222 are provided, each of which is equipped with at least two regions that serve and/or can be used as a protective cover, and each of which or at least one of which is equipped with a region that serves as a cleaning region. The at least one cleaning region can then be assigned in succession to the nozzle bars 213 to be cleaned, whereupon the nozzles of the respective nozzle bar 213 are cleaned. Once all the necessary cleaning steps have been completed, the at least one maintenance device 222 can be positioned such that each of its two regions that serve as a protective cover is assigned to one nozzle bar 213, and said nozzle bars are then lowered onto the common maintenance device 222, preferably following deactivation of the respective positioning drives 226. Each region that serves as a protective cover can selectively be assigned to different nozzle bars 213, for example, enabling some nozzle bars 213 to be arranged in the printing position while at the same time other nozzle bars are covered, to protect them against drying out, for example.

Preferably, however, each nozzle bar 213 is and/or can be assigned its own maintenance device 222, and/or precisely one operating position and precisely one parked position in which the respective maintenance device 222 is and/or can be arranged are assigned to each maintenance device 222. For a total of four nozzle bars 213 of a printing unit 200; 400, a total of four maintenance devices 222 are preferably provided, each being equipped with a region that serves and/or can be used as a protective cover 222, and each being embodied as a cleaning device 222. Once all the necessary cleaning steps have been completed, the at least one maintenance device 222 can be positioned such that each of its regions that serve as a protective cover 222 is assigned to a nozzle bar 213, and said nozzle bars are then lowered onto the common maintenance device 222, for example during deactivation of the respective positioning drives 226, or are held in their maintenance position by shutting off the respective positioning drives 226. A cleaning is preferably carried out, for example, during which the respective maintenance device 222 serves as a protective cover 222, and/or during which a cleaning region and a region that serves as a protective cover 222 are identical. Each maintenance device 222 that serves as a protective cover 222 can be assigned, selectively and independently of other maintenance devices 222, to said respective nozzle bar 213, for example, enabling some nozzle bars 213 to be arranged in the printing position while other nozzle bars 213 are covered and protected against drying out, for example.

The at least one maintenance device 222 is preferably embodied as at least one cleaning device 222. The at least one cleaning device 222 preferably has at least one cleaning module, in particular at least one cleaning module that can be moved in and/or counter to axial direction A relative to the at least one print head 212; 412, by means of at least one cleaning drive. The at least one cleaning module preferably has at least one contact element, which can be placed in contact by means of at least one actuating drive with at least one nozzle surface of the at least one print head 212; 412, at least when cleaning device 222 is located in its operating position and the corresponding print head is located in its maintenance position. The at least one cleaning module preferably has at least one first device for dispensing cleaning agent, for example at least one spray nozzle, which is and/or can be directed toward the at least one print head 212; 412 and/or toward the at least one contact element. The at least one contact element is preferably embodied as at least one wiper.

When at least one print head 212 is arranged in the printing position, at least one nozzle of said at least one print head 212 is preferably located below the staging path along which the at least one maintenance device 222 is preferably arranged so as to move, preferably between the at least one parked position and the at least one operating position, preferably by means of the at least one transport device 223. When the at least one print head 212 is arranged in the idle position, said at least one nozzle is preferably located above said staging path.

An actuating path of at least one print head 212 is preferably a preferably predetermined path along which the at least one print head 212 can be moved, in particular to move the at least one print head 212 between its printing position and its idle position, for example maintenance position and/or assembly position. The actuating path of the at least one print head 212 preferably has no component in axial direction A that is greater than a maximum of 50%, more preferably a maximum of 20%, even more preferably 10% and more preferably still a maximum of 2% of the width of the operating region, measured in axial direction A, of the nozzle bar 213 that contains the at least one print head 212, and/or a maximum of 50%, more preferably a maximum of 20%, even more preferably a maximum of 10% and more preferably still a maximum of 2% of the working width of printing press 01, defined by the maximum printing material width that can be processed in printing press 01. This means that an optionally provided component of the at least one print head 212 in axial direction A is preferably a maximum of 50%, more preferably a maximum of 20%, even more preferably a maximum of 10% and more preferably still a maximum of 2% of the width, measured in axial direction A, of the operating region of the nozzle bar 213 that contains the at least one print head 212, and/or a maximum of 50%, more preferably a maximum of 20%, even more preferably a maximum of 10% and more preferably still a maximum of 2% of the working width of printing press 01, defined by the maximum printing material width that can be processed in printing press 01.

Preferably, at least a first of the at least two print heads 212, in particular of first printing unit 200, can selectively be placed, preferably by means of a first positioning device 217 assigned to said print head, at least either in the first printing position assigned to said print head or in a first idle position, in particular maintenance position and/or assembly position, assigned to said print head, wherein in the at least one first idle position, an idle location of at least one first nozzle of the at least one first of the at least two print heads 212 is spaced by a first idle distance, in particular a maintenance distance and/or an assembly distance, from a first operating location of the same at least one first nozzle of the same at least one first of the at least two print heads 212 in its first printing position. Preferably, at least a second of the at least two print heads 212, in particular of said first printing unit 200, can selectively be placed, preferably by means of a respective second positioning device 218 assigned to said print head, at least either in a second printing position assigned to said print head or in a second idle position, in particular maintenance position and/or assembly position, assigned to said print head, wherein in the at least one second idle position, an idle location of at least one second nozzle of the at least one second of the at least two print heads 212 is spaced by a second idle distance, in particular maintenance distance and/or assembly distance, from a second operating location of the same at least one second nozzle of the same at least one second of the at least two print heads 212 in its second printing position. The first idle distance, in particular maintenance distance and/or assembly distance, preferably differs from the second idle distance, in particular maintenance distance and/or assembly distance, by at least 2 cm, more preferably at least 5 cm, even more preferably at least 10 cm and more preferably still at least 20 cm. An idle distance is particularly a distance between a location of a nozzle when the print head 212 that contains said nozzle is arranged in its idle position and a location of the same nozzle when the same print head 212 is arranged in its printing position.

In particular, the at least one first print head 212 can preferably be selectively placed, by means of at least one first positioning device 217 assigned to said print head, at least either in a first printing position assigned to said print head or in a first idle position, in particular a first maintenance position and/or a first assembly position, assigned to said print head. In particular, the at least one second print head 212 can preferably be selectively placed, by means of at least one second positioning device 218 assigned to said print head, at least either in a second printing position assigned to said print head or in a second idle position, in particular a second maintenance position and/or a second assembly position, assigned to said print head.

Thus printing press 01 and more preferably each printing unit 200; 400 preferably has at least two positioning devices 217; 218; 219; 221, to each of which at least one of the at least two print heads 212; 412 is assigned, and by means of which each of the at least two print heads 212; 412 can be moved and can be selectively placed at least either in a respective printing position and/or in at least one respective idle position, for example a maintenance position and/or an assembly position. More preferably, each printing unit 200; 400 has at least four such positioning devices 217; 218; 219; 221.

Preferably, a minimum distance between the at least one first nozzle of the at least one first print head 212; 412 in its first idle position, in particular a maintenance position and/or an assembly position, and the at least one second nozzle of the at least one second print head 212; 412 in its second idle position, in particular a maintenance position and/or an assembly position, preferably referred to as the idle distance, in particular maintenance distance and/or assembly distance, is at least 2 cm, more preferably at least 5 cm, even more preferably at least 10 cm and more preferably still at least 20 cm greater than a minimum distance between at least the at least one first nozzle of the at least one first print head 212; 412 in its first printing position and the at least one second nozzle of the at least one second print head 212; 412 in its second printing position, preferably referred to as the operating distance.

An ejecting direction of at least one first nozzle of the at least one first print head 212; 412 in the first printing position differs from an ejecting direction of said at least one first nozzle of the at least one print head 212; 412 in the first idle position, in particular maintenance position and/or assembly position, by an angle of at least 5°, more preferably at least 10°, even more preferably at least 15° and more preferably still at least 20°, for example. A location of the at least one nozzle when print head 212 is arranged in the at least one printing position and a location of the at least one nozzle when print head 212 is arranged in the at least one idle position, in particular the maintenance position and/or the assembly position, with respect to axial direction A, defined by rotational axis 207 of the at least one printing material guiding element 201, preferably differ by a maximum of 50%, more preferably a maximum of 20%, even more preferably a maximum of 10% and more preferably still a maximum of 2% of the width, measured in axial direction A, of the operating region of the nozzle bar 213 that contains the at least one print head 212, and/or by a maximum of 50%, more preferably a maximum of 20%, even more preferably a maximum of 10% and more preferably still a maximum of 2% of the working width of printing press 01, defined by the maximum printing material width that can be processed in printing press 01. A plane in which this distance and/or this angle is measured is preferably defined by a surface normal which extends parallel to the axial direction A or deviates from said axial direction A by a maximum of 2°; more preferably, said plane is the axial projection plane.

Said printing press preferably enables a process for positioning at least one print head 212, embodied as an inkjet print head 212, of at least one printing unit 200; 400 of printing press 01, wherein in a throw-off process, at least one print head 212 of the at least one printing unit 200; 400 is moved in at least one actuating direction and/or along an actuating path away from a printing position into at least one idle position, in particular a maintenance position and/or an assembly position, and/or is moved away from a provided transport path of the at least one printing material web 02 and/or is moved away from a printing material guiding element 201 and/or is moved away from a transfer element, and wherein said at least one actuating direction is preferably oriented at least partially and more preferably fully orthogonally to an axial direction A, defined by rotational axis 207 of the at least one printing material guiding element 201.

Figure 10:
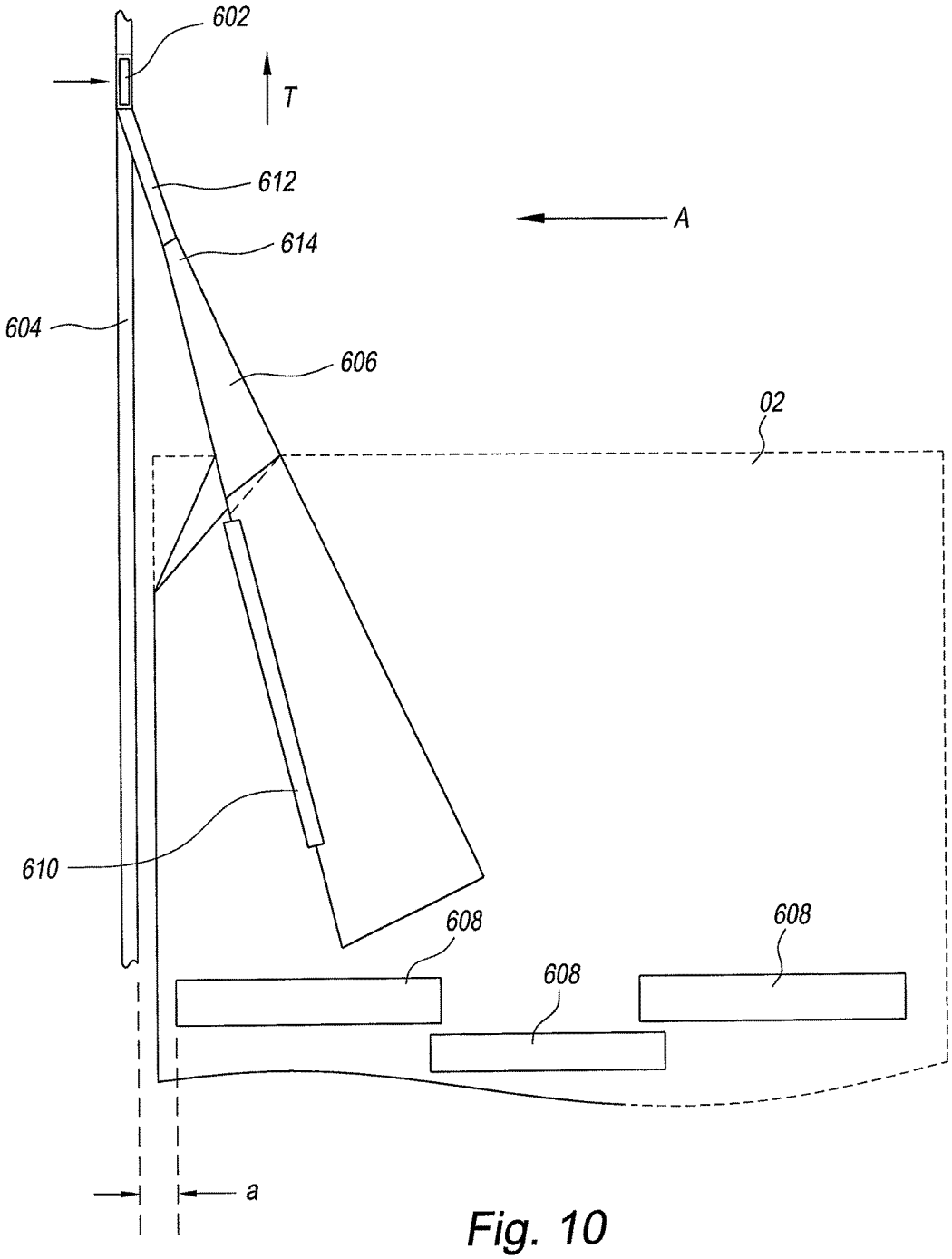
FIG. 10 a schematic depiction of a printing material threading means and threading path taken along the printing material transport path.

At least one threading means 602 which is movable along at least one threading path 604 for threading in a printing material web 02 and/or at least one threading means 602 which is movable along at least one provided transport path of printing material web 02 for threading in a printing material web 02 preferably is and/or can be arranged, at least intermittently, at least within one printing unit 200; 400 of printing press 01, as seen in FIG. 10. Preferably, particularly as described, the at least one print head 212; 412 is embodied as movable along an actuating path in an actuating direction, the actuating direction preferably having at least one component which is oriented orthogonally to an axial direction A defined by the rotational axis 207; 407 of the at least one printing material guiding element 201; 401. At least parts of the at least one threading path 604, and more preferably the entire threading path 604, preferably are/is spaced, with respect to axial direction A, from every target region 608 of every nozzle of every print head 212; 412 of said printing unit 200; 400 by a distance "a" of at least 2 cm, more preferably at least 4 cm, even more preferably at least 6 cm and more preferably still at least 8 cm. At least parts of the threading means 602 and more preferably the entire threading means 602 preferably are/is spaced, with respect to axial direction A, from every target region 608 of every nozzle of every print head 212; 412 of said printing unit 200; 400 by a distance "a" of at least 2 cm, more preferably at least 4 cm, even more preferably at least 6 cm and more preferably still at least 8 cm.

In particular, the at least one threading path 604 and/or the at least one threading means 602 is preferably arranged outside the operating region of a nozzle bar 213 that contains the at least one print head 212, and/or outside a working width of printing press 01, with respect to axial direction A. The actuating direction of the at least one print head 212 preferably has at least one component in a direction of a normal vector of a surface element, closest to the at least one print head 212; 412, of the provided transport path of printing material web 02. This means that the at least one print head 212 is arranged such that it can be moved away from and/or thrown off of the provided transport path, in particular for threading a printing material web 02 into printing press 01 and/or in particular by means of at least one positioning device 217; 218; 219; 221. Preferably, printing press 01 at least intermittently and more preferably permanently has at least one and more preferably precisely one threading means 602 for threading in a printing material web 02 along a provided transport path of printing material web 02.

At least one printing material web 02 preferably is and/or can be connected via at least one connecting element 606, more preferably embodied as at least one threading tip 606, to the at least one threading means 602, in particular regardless of whether the at least one threading means 602 is embodied as a threading belt and/or a threading chain and/or as a continuous threading means and/or a finite threading means. A threading tip 606 is preferably a flat means, the smallest dimension of which preferably measures less than 5 mm, and which is preferably substantially triangular in shape, and along one edge of which a bonding agent 610 and/or adhesive agent 610 is preferably provided, and which preferably has at least one fastening means 612 at a tip 614 that is opposite said edge. The bonding agent 610 and/or adhesive agent 610 preferably serves to connect the threading tip 606 to a printing material 02. The at least one fastening means 612 preferably serves to detachably secure the threading tip 606 to the at least one threading means 602, as all depicted in FIG. 10.

The at least one threading means 602 is preferably embodied as at least one continuous threading means 602, for example as at least one continuous threading belt. Alternatively, the at least one threading means 602 is embodied as at least one finite threading means, for example as a finite threading belt and/or as a finite threading chain. Once a threading process is completed, a finite threading belt is preferably wound back up, that is, it is moved in the opposite direction along the threading path. At least one threading drive (not shown) is preferably provided, which can be used for moving the at least one threading means 602 along the at least one threading path 604. In the case of a continuous threading means 602, it is sufficient for precisely one such threading drive to be provided, for example. Alternatively, the at least one threading means 602 is embodied as finite. In that case, at least one threading storage device is preferably provided, in which the at least one threading means can be at least intermittently arranged, particularly as long as it is not being used for threading a printing material web 02. In an alternative embodiment, the at least one threading means 602 is embodied as at least one finite threading chain. In the preferred case of the at least one finite threading means 602, the at least one threading means 602 for threading in a printing material web 02 along the provided transport path of printing material web 02 is preferably arranged, particularly permanently, along its at least one threading path within printing press 01. More preferably, the at least one threading means 602 for threading in a printing material web 02 along the provided transport path of printing material web 02 is particularly arranged permanently along its at least one threading path within the at least one printing unit 200; 400 of printing press 01.

At least one threading guide element is preferably provided, by means of which at least one threading path of the at least one threading means can be and/or is defined. The at least one threading guide element is embodied, for example, as at least one turning roller. Alternatively, the at least one threading guide element is embodied as at least one chain guide. Preferably, the at least one threading guide element is embodied as at least one rotatable threading guide element, for example as at least one turning roller. The at least one rotatable threading guide element and particularly the at least one turning roller is preferably arranged so as to rotate around the same rotational axis 207; 407 as at least one printing material guiding element 201; 401 of a printing unit 200; 400 of printing press 01, for example the same rotational axis as the at least one central cylinder 201; 401. A chain guide, in particular, can also have switching points for producing different threading paths.

The at least one preferably continuous threading means 602 preferably has, in each case, at least two and more preferably at least five designated connecting points, at which at least one printing material web 02 can be connected directly and/or via at least one connecting element, for example, a threading tip 606, to the at least one threading means 602. The at least two and more preferably at least five connecting points are preferably spaced with respect to axial direction A by a maximum distance of 10 cm (ten centimeters), more preferably a maximum of 5 cm (five centimeters), even more preferably a maximum of 2 cm (two centimeters) and more preferably still by no distance at all. Even more preferably, the at least two and more preferably at least five connecting points are arranged in the same position with respect to axial direction A. The at least two and more preferably at least five connecting points are preferably spaced from one another along the at least one and preferably precisely one threading path, more preferably by at least 10 cm (ten centimeters), even more preferably by at least 50 cm (fifty centimeters) and more preferably still by at least 100 cm (one hundred centimeters). The at least one threading means 602 has connecting points embodied as eyes and/or hooks, for example, and/or the at least one connecting element accordingly has at least one hook and/or at least one eye. One such hook and/or one such eye forms the at least one fastening means, for example.

The threading path 604 of the at least one threading means 602 preferably wraps around the at least one rotatable printing material guiding element 201; 401, more preferably embodied as at least one central cylinder 201; 401, over an angular range of at least 180° and more preferably of at least 270° as viewed from a rotational axis 207; 407 of the at least one printing material guiding element 201; 401, and/or as viewed in the axial projection plane. The threading path 604 of the at least one threading means 602, at least along this angular range, preferably has a radius of curvature that deviates a maximum of 5 cm, more preferably a maximum of 2 cm and even more preferably a maximum of 1 cm from a radius of curvature of this at least one printing material guiding element 201; 401, in particular this central cylinder 201; 401.

A projection, particularly in the axial projection plane, of the transport path provided for printing material 02 in axial direction A and a projection, particularly in the axial projection plane, of the threading path 604 provided for the at least one threading means 602 in axial direction A preferably overlap at least partially, more preferably over more than 25% of the length of the projection of the threading path provided for the threading means, and even more preferably over more than 50% of this length.

This printing press preferably enables a method for threading at least one printing material web 02 into at least one printing unit 200; 400 of printing press 01, wherein in a throw off process, at least one print head 212, embodied as an inkjet print head 212, of the at least one printing unit 200; 400 is moved in at least one actuating direction and/or along one actuating path away from a provided transport path of the at least one printing material web 02, and wherein this at least one actuating direction is preferably oriented at least partially and more preferably fully orthogonally to an axial direction A defined by rotational axis 207 of the at least one printing material guiding element 201, and wherein in a subsequent threading in process, at least one threading means 602 is moved along a threading path 604 through the at least one printing unit 200; 400, thereby drawing the at least one printing material web 02 along a provided transport path for the at least one printing material web 02, and wherein the threading path 604 and the transport path, as viewed in the axial direction A, are spaced from one another, preferably by at least 2 cm, more preferably by at least 4 cm, even more preferably by at least 6 cm and more preferably still by at least 8 cm. For threading in the at least one printing material web 02, it is not necessary to move the at least one print head 212 all the way to its maintenance position and/or its assembly position in the throw-off process. It is sufficient merely to protect the at least one print head 212 from damage, as long as it is spaced a sufficient distance from printing material 02 and/or from the connecting element 606. In a subsequent throw-on process, the at least one print head 212 is preferably moved opposite the at least one actuating direction and/or along an actuating path toward the provided transport path of the at least one printing material web 02 and/or is positioned in its printing position.

In a connecting process, particularly prior to the threading process, the at least one threading means 602 is preferably connected to the at least one printing material web 02 by means of at least one connecting element 606. In the connecting process, the at least one threading means 602 is preferably connected by means of the at least one connecting element 606 to the at least one printing material web 02 at precisely one of the at least two, more preferably at least five connecting points provided on the at least one threading means. The at least one connecting element 606 preferably passes through a printing position of the at least one print head 212 while said print head is moved away from the provided transport path and/or is arranged in at least one idle position. During the threading process, the at least one connecting element 606 preferably passes through at least one target region of at least one nozzle of the at least one print head 212. During the threading process, preferably no component of the at least one threading means 602 passes through any target region of any nozzle of the at least one print head 212. This means that all of the components of the at least one threading means 602 preferably bypass every target region 608 of every nozzle of the at least one print head 212.

This results in at least one operating mode in which the at least one threading means 602 is connected to printing material 02 by means of the at least one connecting element 606, and in which the at least one print head 212 is moved away from the provided transport path and/or is arranged in at least one idle position, and in which at least one nozzle is preferably oriented with its ejecting direction toward the at least one connecting element 606. In said at least one operating mode, the at least one connecting element 606 is preferably in contact with the at least one printing material guiding element 201, in particular with the at least one central cylinder 201. Alternatively or additionally, in said at least one operating mode, the at least one connecting element 606 is preferably in contact with at least one transfer element. In this operating mode, the at least one threading means 602 is preferably spaced a distance "a" of at least 2 cm, more preferably at least 4 cm, even more preferably at least 6 cm, and more preferably still at least 8 cm with respect to axial direction A from every target region 608 of every nozzle of every print head 212; 412 of said printing unit 200; 400.

Preferably, only at least one threading means 602 is provided, said threading means 602 being arranged on only one side of the provided transport path for printing material 02, with respect to axial direction A, and/or the threading path of said threading means 602 extending on only one side of the provided transport path for printing material 02. Preferably, only at least one threading means 602 is used, said threading means 602 being arranged on only one side of the provided transport path for printing material 02, with respect to axial direction A, and/or the threading path of said threading means extending on only one side of the provided transport path for printing material 02.

Once printing material web 02 has passed the at least one first printing unit 200, printing material web 02 is transported further along its transport path and is preferably fed to the at least one first dryer 301 of the at least one dryer unit 300. The first side of printing material web 02, which has been imprinted by the at least one first printing unit 200, preferably is not in contact with any component of web-fed printing press 01 between a last point of contact of printing material web 02 with the at least one first central cylinder 201 of the at least one first printing unit 200 and an area of action of the at least one first dryer 301. The second side of printing material web 02, which particularly has not been imprinted by first printing unit 200 and which is in contact with the at least one first central cylinder 201 of the at least one first printing unit 200, is preferably in contact with at least one turning roller 214 of the at least one first printing unit 200 and/or with at least one turning roller 312 of the at least one first dryer 301, between the last point of contact of printing material web 02 with first central cylinder 201 of the at least one first printing unit 200 and the area of action of the at least one first dryer 301. At least one third measuring device 214, more preferably embodied as a third measuring roller 214, is preferably provided. This third measuring device 214 is used to measure web tension. Further preferably, the at least one turning roller 214 of first printing unit 200 is identical to the third measuring device 214 embodied as the third measuring roller 214.

The at least one first dryer 301 is preferably embodied as an infrared radiation dryer 301. The at least one first dryer 301 preferably has at least one radiation source 302, preferably embodied as an infrared radiation source 302. A radiation source 302, preferably an infrared radiation source 302, in this case is a device by means of which electrical energy is and/or can be purposely converted to radiation, preferably infrared radiation, and is and/or can be directed toward printing material web 02. The at least one radiation source 302 preferably has a defined area of action. The area of action of a radiation source 302 is particularly the area that contains every point that can be connected, in a straight line and without interruption, directly or via reflectors to the radiation source 302. The area of action of the at least one first dryer 301 is composed of the areas of action of all radiation sources 302 of the at least one first dryer 301. The area of action of the at least one first dryer 301 preferably points from the at least one radiation source 302 to a part of the transport path of printing material web 02 that is closest to the at least one radiation source 302. Air is introduced into the interior of the at least one first dryer 301 through at least one ventilation opening. Inside first dryer 301, water and/or solvent from the printing inks to be removed from printing material web 02 is removed by means of the infrared radiation and is absorbed into the introduced air. This air is then removed from the at least one first dryer 301 through at least one venting opening.

In a preferred embodiment, the provided transport path for printing material 02 through the at least one first dryer 301 has at least two sub-sections, each extending in directions that have vertical components, more preferably greater vertical components than any optionally provided horizontal components. The provided transport path of the printing material along the one sub-section preferably extends with at least one component in an upward vertical direction. The provided transport path of the printing material along the other sub-section preferably extends with at least one component in a downward vertical direction. The one sub-section and the other sub-section of the provided transport path are preferably connected to one another by means of at least one provided connecting section of the provided transport path. The at least one connecting section preferably extends in a direction having a horizontal component, more preferably having a greater horizontal component than an optionally provided vertical component. As a result, the at least one dryer 301 can preferably be particularly compact in configuration.

At least one first cooling unit 303 is preferably arranged downstream of the area of action of the at least one radiation source 302 of the at least one first dryer 301 in the direction of transport of printing material web 02. The at least one first cooling unit 303 preferably comprises at least one first cooling roller 304 and preferably a first cooling pressure roller 306, which can be and/or is thrown onto the at least one first cooling roller 304, and preferably comprises at least one turning roller 307; 308 that can be and/or is thrown onto the at least one first cooling roller 304. A first drive motor 311, embodied as a first cooling roller drive motor 311 and assigned to the at least one first cooling roller 304, and the first cooling pressure roller 306 are preferably part of a web tension adjusting unit, that is, they are arranged so as to adjust the web tension and for this purpose are preferably connected at least partially and/or intermittently to the higher level machine controller. The at least one first cooling roller 304 preferably represents at least one fourth motor-driven rotational body 304. Printing material web 02 wraps around and contacts, preferably along its transport path, the at least one first cooling roller 304 with a wrap angle of preferably at least 180° and more preferably at least 270°. The first cooling pressure roller 306 and the at least one first cooling roller 304 together preferably form a first cooling nip 309, in which printing material web 02 is preferably arranged and/or through which printing material web 02 preferably passes. Printing material web 02 is thereby pressed by cooling pressure roller 306 against the at least one first cooling roller 304. The at least one first cooling roller 304 of the at least one first cooling unit 303 is preferably embodied as a cooling roller 304 through which a coolant flows.

Along the transport path of printing material web 02, downstream of the at least one first cooling unit 303, at least one second printing unit 400 is preferably arranged. Along the transport path of printing material web 02, preferably immediately upstream of the at least one second printing unit 400 and preferably downstream of the at least one first dryer 301, and particularly downstream of the at least one first printing unit 200, at least one second web edge aligner, which can preferably be controlled and/or regulated manually or automatically, is preferably provided. The at least one second printing unit 400 is similar in configuration to first printing unit 200. In particular, second printing unit 400 has a second central printing cylinder 401, or a central cylinder 401, around which printing material 02 wraps during printing operation, likewise with a wrap angle of preferably at least 180° and more preferably at least 270°. Second central cylinder 401 preferably represents a fifth motor-driven rotational body 401. The rotational direction of second central cylinder 401 of second printing unit 400 is preferably opposite the rotational direction of the at least one first central cylinder 201. Along the transport path of printing material web 02 upstream of second central cylinder 401 of second printing unit 400, a second printing material cleaning device 402 or web cleaning device 402 is preferably arranged so as to act on printing material web 02.

The transport path of printing material web 02 through the at least one second printing unit 400 extends similarly to the transport path through the at least one first printing unit 200. In particular, printing material web 02 preferably wraps around part of a second turning roller 403 and is turned by said roller such that the transport path of printing material web 02 in the second gap 404 extends both tangentially to second turning roller 403 and tangentially to second central cylinder 401. At least one cylinder 406, embodied as a second impression cylinder 406, is preferably arranged in second printing unit 400. Second impression cylinder 406 is preferably similar in configuration and arrangement to first impression cylinder 206, particularly in terms of its movability and in terms of a second impression nip 409. Second central cylinder 401 is preferably similar in arrangement and configuration to first central cylinder 201, particularly with respect to a second drive motor 408 of second central cylinder 401 and with respect to a corresponding preferably provided second rotational angle sensor, which is embodied to measure and/or be capable of measuring the angular position of second drive motor 408 and/or of second central cylinder 401 itself and to transmit and/or be capable of transmitting this measurement to the higher level machine controller.

Within second printing unit 400, at least one second printing element 411, embodied as an inkjet printing element 411 or ink-jet printing element 411, is preferably arranged downstream of second impression cylinder 406 in the direction of rotation of second central cylinder 401, and therefore along the transport path of printing material web 02, aligned toward second central cylinder 401. The at least one second printing element 411 of the at least one second printing unit 400 is preferably identical to the at least one first printing element 211 of the at least one first printing unit 200, particularly with respect to at least one nozzle bar 413, at least one print head 412 embodied as an inkjet print head 412 and the arrangement thereof in double rows, the implementation and resolution of the printing process, the arrangement, alignment and actuation of the nozzles and the movability and adjustability of the at least one nozzle bar 413 and the at least one print head 412 by means of at least one adjustment mechanism having a corresponding electric motor. A similar protective cover and/or cleaning device is also preferably provided. The proper alignment of the print heads 412 of the at least one second printing unit 400 is also preferably monitored by at least one sensor which detects a printed image and the machine controller which evaluates said printed image. This at least one sensor is preferably at least one second printed image sensor, which is similar in embodiment to the at least one first printed image sensor. The at least one second printing element 411 is preferably embodied as a four-color printing element 411.

At least one second dryer 331 is arranged downstream of the at least one second printing unit 400 with respect to the transport path of printing material web 02. Once printing material web 02 has passed through the at least one second printing unit 400, printing material web 02 is transported further along its transport path and is preferably fed to the at least one second dryer 331 of the at least one dryer unit 300. The at least one second dryer 331 is preferably similar in configuration to the at least one first dryer 301. The at least one first dryer 301 and the at least one second dryer 331 are components of the at least one dryer unit 300. The second side of printing material web 02, which has been imprinted by the at least one second printing unit 400, is preferably not in contact with any component of web-fed printing press 01 between a last point of contact of printing material web 02 with second central cylinder 401 of the at least one second printing unit 400 and an area of action of the at least one second dryer 301. At least one turning roller 414 is preferably provided in second printing unit 400. Said at least one turning roller 414 is preferably embodied as a fifth measuring device 414, in particular a fifth measuring roller 414.

The configuration of the at least one second dryer 331 is similar to the configuration of the at least one first dryer 301, particularly with respect to a transport path provided for printing material and/or with respect to its embodiment as an air flow dryer 331 and/or a radiation dryer 331 and/or a hot air dryer 331 and/or an infrared radiation dryer 331 and/or a UV radiation dryer 331. In particular, the at least one second dryer 331 preferably has at least one second cooling roller 334, which preferably represents at least one sixth motor-driven rotational body 334. The second cooling roller 334 preferably is and/or can be driven by means of a second cooling roller drive 341. The at least one second dryer 331 is preferably substantially and more preferably fully symmetrical in configuration to the at least one first dryer 301. The at least one second dryer 331 is preferably part of the same dryer unit 300 as the at least one first dryer 301 and is more preferably arranged in the same housing 329. In terms of a spatial arrangement, dryer unit 300, and therefore preferably the at least one first dryer 301 and the at least one second dryer 331, is preferably arranged between the at least one first printing unit 200 and the at least one second printing unit 400.

Along the transport path of printing material web 02, downstream of the at least one second dryer 331, at least one outfeed roller 501 is provided. The at least one outfeed roller 501 preferably has its own drive motor 504, embodied as outfeed roller drive 504. The at least one outfeed roller 504 preferably represents at least one seventh motor-driven rotational body 504. The at least one outfeed roller 501, preferably together with an outfeed pressure roller 502 that is and/or can be thrown onto the at least one outfeed roller 501, forms an outfeed nip 503, in which printing material web 02 is clamped and through which printing material web 02 is transported. Outfeed nip 503 preferably serves to regulate web tension and/or to transport printing material web 02.

With respect to the transport path of printing material web 02 upstream and/or downstream of outfeed roller 501, but particularly along the transport path of printing material 02 downstream of the at least one first dryer 301, at least one rewetting unit is preferably provided, which preferably compensates for any excess loss of moisture in printing material web 02 as a result of treatment by dryer unit 300.

Along the transport path of printing material web 02 downstream of outfeed nip 503 and/or downstream of the rewetting unit, at least one post-processing unit 500 is arranged, which is preferably embodied as a folding apparatus 500 and/or has a sheet cutter 500 and/or a planar delivery unit 500, or is embodied as a winding apparatus 500. In and/or by means of this post-processing unit 500, printing material web 02 is preferably folded and/or cut and/or stitched and/or sorted and/or inserted and/or transported and/or wound.

In at least one variant of the printing press, printing press 01 is embodied as a web-fed rotary inkjet printing press 01, and at least one transfer element is arranged so as to form a transfer nip with the at least one first central printing cylinder 201. In that case, the at least one print head 212 is preferably aligned toward the at least one transfer element.

While preferred embodiments of a printing press and a method for threading a printing material web into a printing unit of a printing press, in accordance with the present invention, have been set forth fully and completely hereinabove, it will be apparent to one of skill in the art that various changes could be made without departing from the true spirit and scope of the present invention which is accordingly to be limited only by the appended claims.

What is claimed is:

1. A printing press comprising:

at least one printing unit which has at least one print head embodied as an inkjet print head having nozzles;

at least one printing material guiding element which is rotatable around a respective rotational axis and having an axial direction, the at least one print head being movable along an actuating path in at least one actuating direction between a printing position and an idle position, the at least one actuating direction having at least one movement component oriented orthogonally to the axial direction which is defined by the rotational axis of the at least one printing material guiding element;

at least one threading means which can be moved along at least one threading path for threading in a printing material web, the at least one threading means including at least one connecting element that is engageable with the printing material web during threading of the printing material web through the printing press along a printing material web transport path, the at least one threading means being arranged, at least intermittently, within the at least one printing unit, the at least one connecting element being movable through a printing position of the at least one print head when that at least one print head is moved out of its printing position and away from the printing material web transport path; and wherein at least portions of the at least one threading path for the at least one threading means are spaced at a distance of at least 2 cm in the axial direction, from a target region of every nozzle of the at least one print head of the at least one printing unit.

2. The printing press according to claim 1, characterized in that the at least one connecting element is embodied as at least one threading tip.

3. The printing press according to claim 1, characterized in that the at least one print head can be selectively placed in at least one of its printing position and its idle position, in which idle position an idle location of at least one nozzle of the at least one print head is spaced at an idle distance from an operating location of the same at least one nozzle of the same at least one print head in its printing position.

4. The printing press according to claim 1, characterized in that the at least one rotatable printing material guiding element is arranged in the at least one printing unit, and wherein an ejecting direction of at least one nozzle of the at least one print head, at least in a printing position, is aligned toward a circumferential surface of the at least one rotatable printing material guiding element and that the at least one rotatable printing material guiding element is embodied as at least one central cylinder.

5. The printing press according to claim 1, characterized in that the at least one print head can be placed in at least one maintenance position, in which maintenance position, at least one maintenance device is assigned to at least one nozzle of the at least one print head, and wherein a location of that at least one nozzle, in the at least one printing position, and a location of that least one nozzle, in the at least one maintenance position, differ with respect to the axial direction defined by the rotational axis of the at least one printing material guiding element, by one of a maximum of 50% of a width, measured in the axial direction, of an operating region of a nozzle bar that contains the at least one print head and a maximum of 50% of a working width of the printing press, defined by a maximum width of a printing material that can be processed in the printing press.

6. The printing press according to claim 5, further including at least one maintenance device which is movable along at least one staging path between at least one parked position and at least one operating position and wherein a component of the staging path of the at least one maintenance device, in the axial direction, amounts to one of a maximum of 50% of a width, measured in the axial direction, of an operating region of a nozzle bar that contains said at least one print head, and a maximum of 50% of a working width of the printing press, defined by a maximum width of a printing material that can be processed in the printing press.

7. The printing press according to claim 1, characterized in that at least one of the threading path and the at least one threading means is located outside of one of an operating region of a nozzle bar that contains the at least one print head and outside of a working width of the printing press, with respect to the axial direction.

8. The printing press according to claim 1, characterized in that the printing unit has at least two print heads, wherein each of the at least two print heads is movable by a respective positioning device assigned to that print head along a respective linear actuating path, wherein the linear actuating paths of the at least two print heads point in respective actuating directions that differ in pairs by at least 10° and by at most 150°, and further wherein each of the at least two print heads can selectively be placed, by its respective positioning device, at least in one of the printing position assigned to that print head and in at least one maintenance position assigned to that print head.

9. A method for threading at least one printing material web into at least one printing unit of a printing press, the at least one printing unit having an axial direction extending parallel to a rotational axis of at least one rotatable printing material guiding element of the at least one printing unit including;

moving, in a throw-off process, at least one print head, embodied as an inkjet print head, of the at least one printing unit in at least one actuating direction away from a provided transport path of the at least one printing material web in the at least one printing unit;

providing at least one threading means;

connecting the at least one threading means, in a connecting process, to the at least one printing material web by using at least one connecting element of the at least one threading means;

moving, in a subsequent threading in process, the at least one threading means along a threading path through the at least one printing unit;

drawing the at least one printing material web connected to the at least one threading means, using the at least one connecting element, along the transport path of the at least one printing material web;

spacing the threading path and the transport path from one another as viewed in the axial direction; and passing the at least one connecting element of the at least one threading means through a printing position of the at least one print head while said at least one print head is moved, in the throw-off process, away from the provided transport path and is arranged in at least one idle position.

10. The method according to claim 9, further including using only one threading means, and arranging said only one threading means on one of only one side of the provided transport path for printing material and on the threading path of said threading means extending on only one side of the provided transport path for printing material, with respect to the axial direction.

11. The method according to claim 9, further including locating one of the at least one threading path and the at least one threading means outside of one of an operating region of a nozzle bar that contains the at least one print head and outside of a working width of the printing press, with respect to the axial direction.

* * * * *